US010604985B2

(12) United States Patent
Grace

(10) Patent No.: US 10,604,985 B2
(45) Date of Patent: Mar. 31, 2020

(54) VERTICAL DOOR SYSTEM WITH BALL SCREW DRIVE

(71) Applicant: James Scott Grace, Jamestown, RI (US)

(72) Inventor: James Scott Grace, Jamestown, RI (US)

(73) Assignee: DoorWall Systems Corporation, Warwick, RI (US)

( * ) Notice: Subject to any disclaimer, the term of this patent is extended or adjusted under 35 U.S.C. 154(b) by 66 days.

(21) Appl. No.: 15/638,702

(22) Filed: Jun. 30, 2017

(65) Prior Publication Data

US 2018/0002971 A1 Jan. 4, 2018

Related U.S. Application Data

(60) Provisional application No. 62/357,761, filed on Jul. 1, 2016.

(51) Int. Cl.
*E05F 15/673* (2015.01)
*E06B 3/50* (2006.01)
(Continued)

(52) U.S. Cl.
CPC ..... *E05F 15/673* (2015.01); *E06B 3/44* (2013.01); *E06B 3/4407* (2013.01); *E06B 3/483* (2013.01); *E06B 3/5009* (2013.01); *E06B 3/5018* (2013.01); *E05Y 2201/684* (2013.01); *E05Y 2201/696* (2013.01); *E05Y 2201/70* (2013.01); *E05Y 2201/718* (2013.01); *E05Y 2900/106* (2013.01); *E06B 3/26303* (2013.01); *E06B 3/549* (2013.01); *E06B 3/5807* (2013.01); *E06B 3/5878* (2013.01); *E06B 2003/6223* (2013.01); *E06B 2003/6258* (2013.01); *E06B 2003/7044* (2013.01)

(58) Field of Classification Search
CPC ..... E05F 15/673; E05F 15/665; E05F 15/51; E05F 15/262; E06B 3/483
See application file for complete search history.

(56) References Cited

U.S. PATENT DOCUMENTS 1,172,561 A * 2/1916 Rowntree ..... E05F 15/51 160/117
4,133,437 A 1/1979 Gates
(Continued)

FOREIGN PATENT DOCUMENTS

CN 2155426 2/1994
JP 2008-190208 8/2008

OTHER PUBLICATIONS

International Search Report and Written Opinion dated Sep. 25, 2017 which issued in the corresponding International Patent Application No. PCT/US17/40217.

*Primary Examiner* — Brian D Mattei
(74) *Attorney, Agent, or Firm* — Cozen O'Connor

(57) ABSTRACT

A vertical door system includes: a door having a door frame, the door frame having at least one frame section; an operator; two vertical supports configured to: (a) be installable on opposite sides of the door opening and (b) support the vertical door, at least one of the vertical supports having: a guide track on a surface of the vertical support facing toward the door opening; and a drive system having: an elongated threaded rod drivable by the operator via a gearing arranged between the operator and the threaded rod; and one or more blocks, each block comprising a guide track connecting portion that connects to a guide track so the connected block is freely movable along the guide track, each block having a through-bore for accepting the threaded rod so that the block is positioned on the threaded rod and is movable along the threaded rod.

13 Claims, 27 Drawing Sheets

(51) Int. Cl.

| | |
|---|---|
| ***E06B 3/44*** | (2006.01) |
| ***E06B 3/48*** | (2006.01) |
| ***E06B 3/263*** | (2006.01) |
| ***E06B 3/58*** | (2006.01) |
| ***E06B 3/70*** | (2006.01) |
| ***E06B 3/62*** | (2006.01) |
| ***E06B 3/54*** | (2006.01) |

(56) References Cited

U.S. PATENT DOCUMENTS

| | | | | |
|---|---|---|---|---|
| 4,552,403 | A * | 11/1985 | Yindra | A61G 13/02 108/147 |
| 5,533,561 | A | 7/1996 | Forehand, IV | |
| 5,927,038 | A * | 7/1999 | Goldberg | E04B 2/821 403/109.1 |
| 6,056,037 | A * | 5/2000 | Jonkman, Sr. | E05D 15/262 160/118 |
| 9,593,525 | B1 | 3/2017 | Morris et al. | |
| 2010/0218429 | A1* | 9/2010 | Shanahan | E06B 7/16 49/413 |
| 2010/0264596 | A1* | 10/2010 | Whitley | B65G 69/287 277/316 |
| 2011/0197515 | A1* | 8/2011 | Joray | E05D 15/0665 49/425 |
| 2013/0008917 | A1* | 1/2013 | Huang | E06B 3/483 220/810 |
| 2013/0167444 | A1* | 7/2013 | Ryden | E05F 1/16 49/417 |
| 2013/0319623 | A1* | 12/2013 | Crown | E06B 3/483 160/224 |
| 2015/0152676 | A1* | 6/2015 | Plummer | E05F 15/603 49/280 |
| 2017/0074021 | A1* | 3/2017 | Rodems | E05D 15/08 |
| 2018/0238097 | A1* | 8/2018 | Plummer | E05F 15/603 |

* cited by examiner

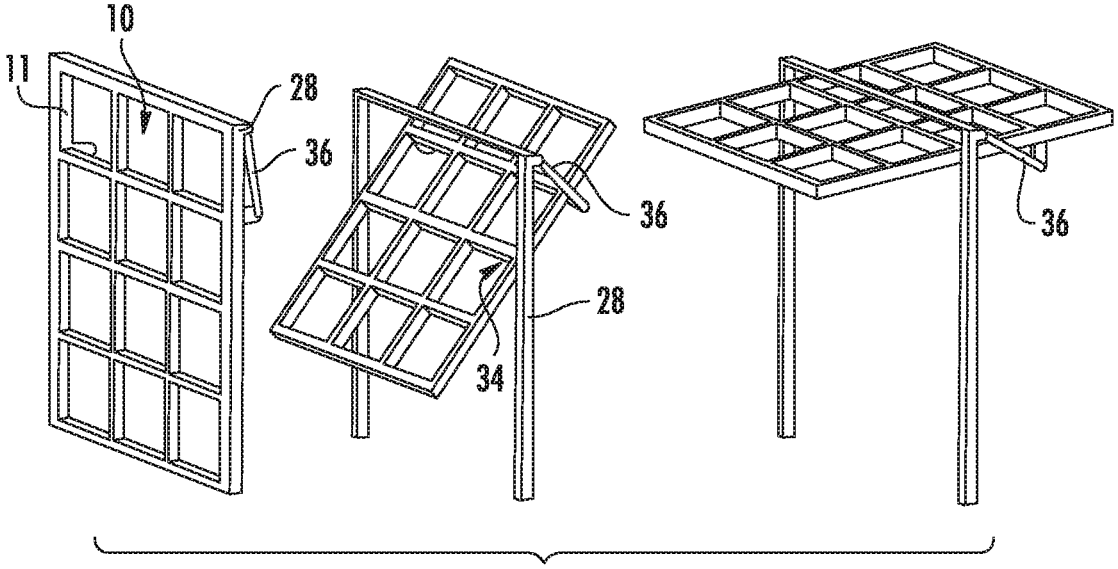
FIG. 4A1
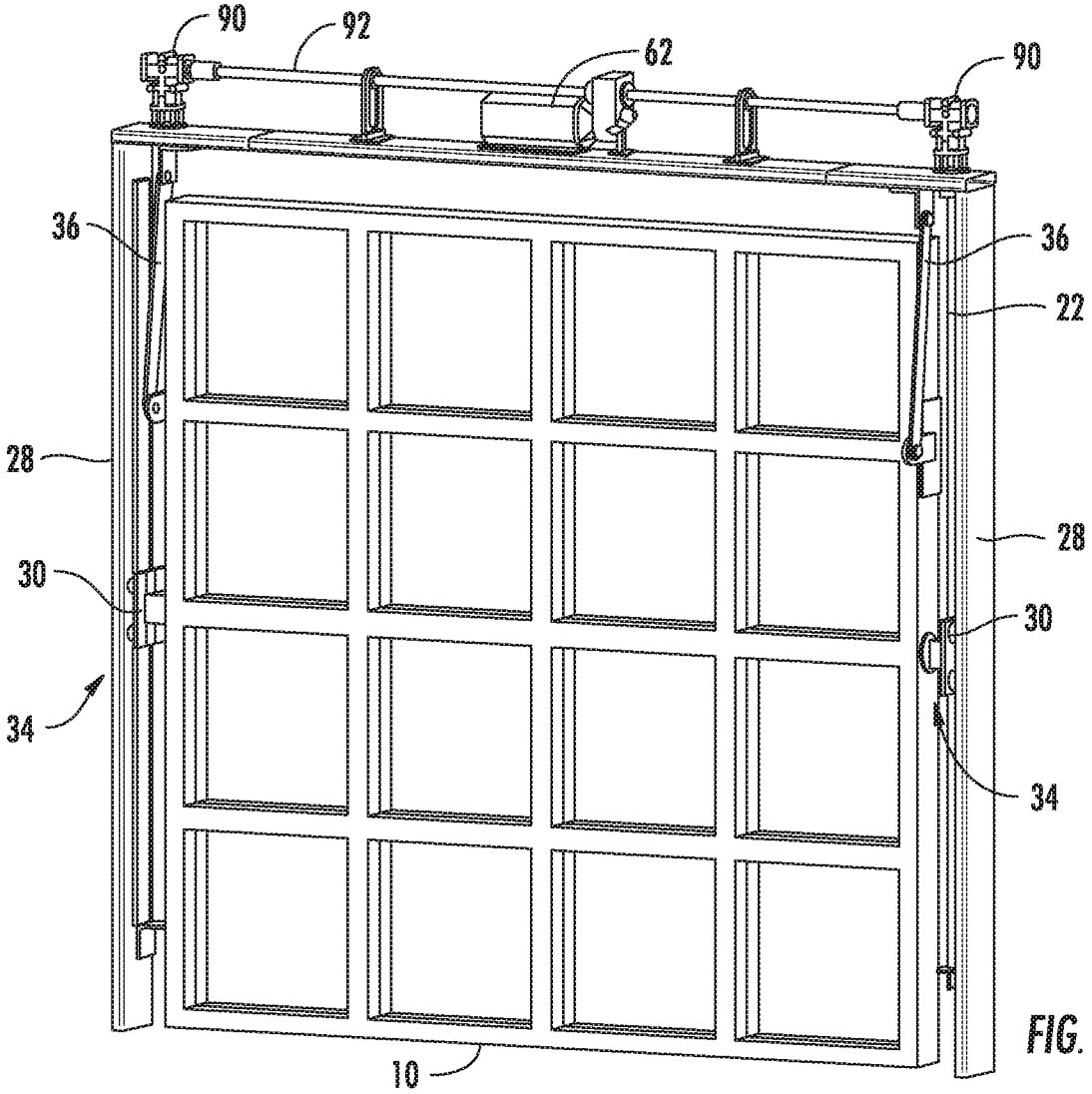
FIG. 4A2

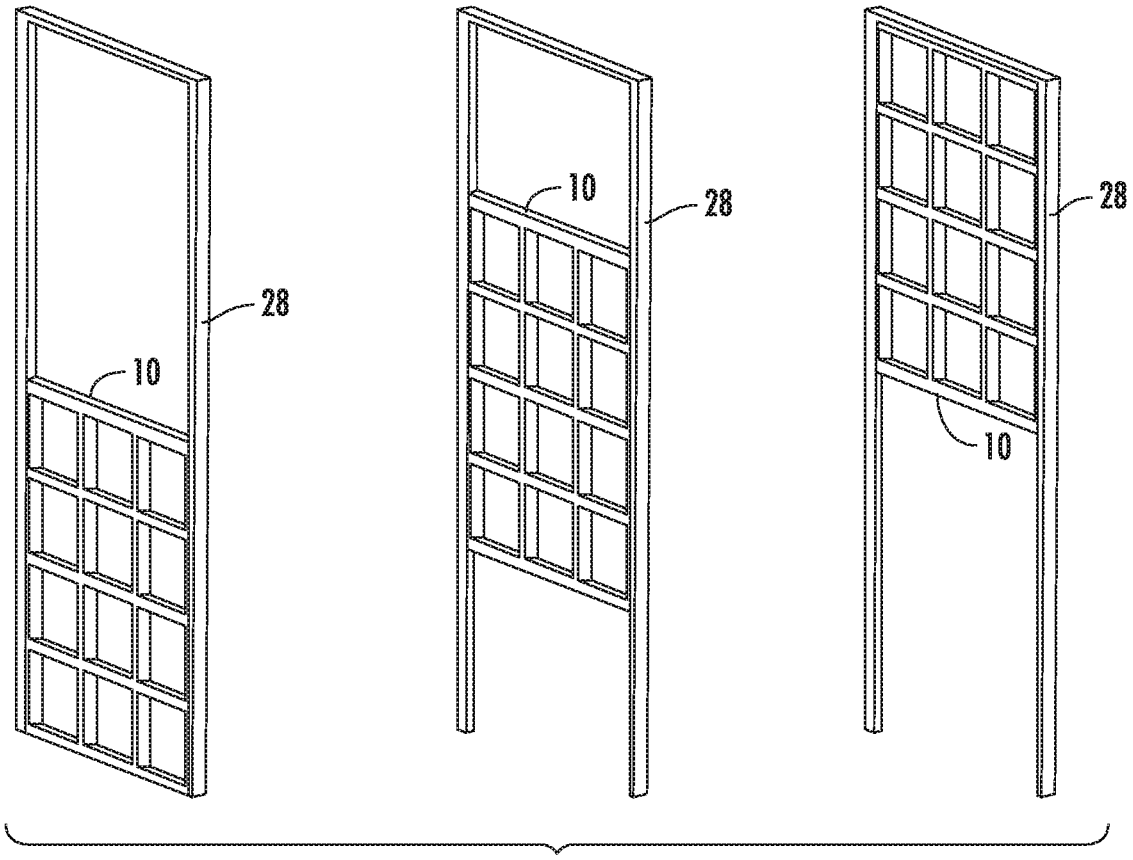
FIG. 4B1

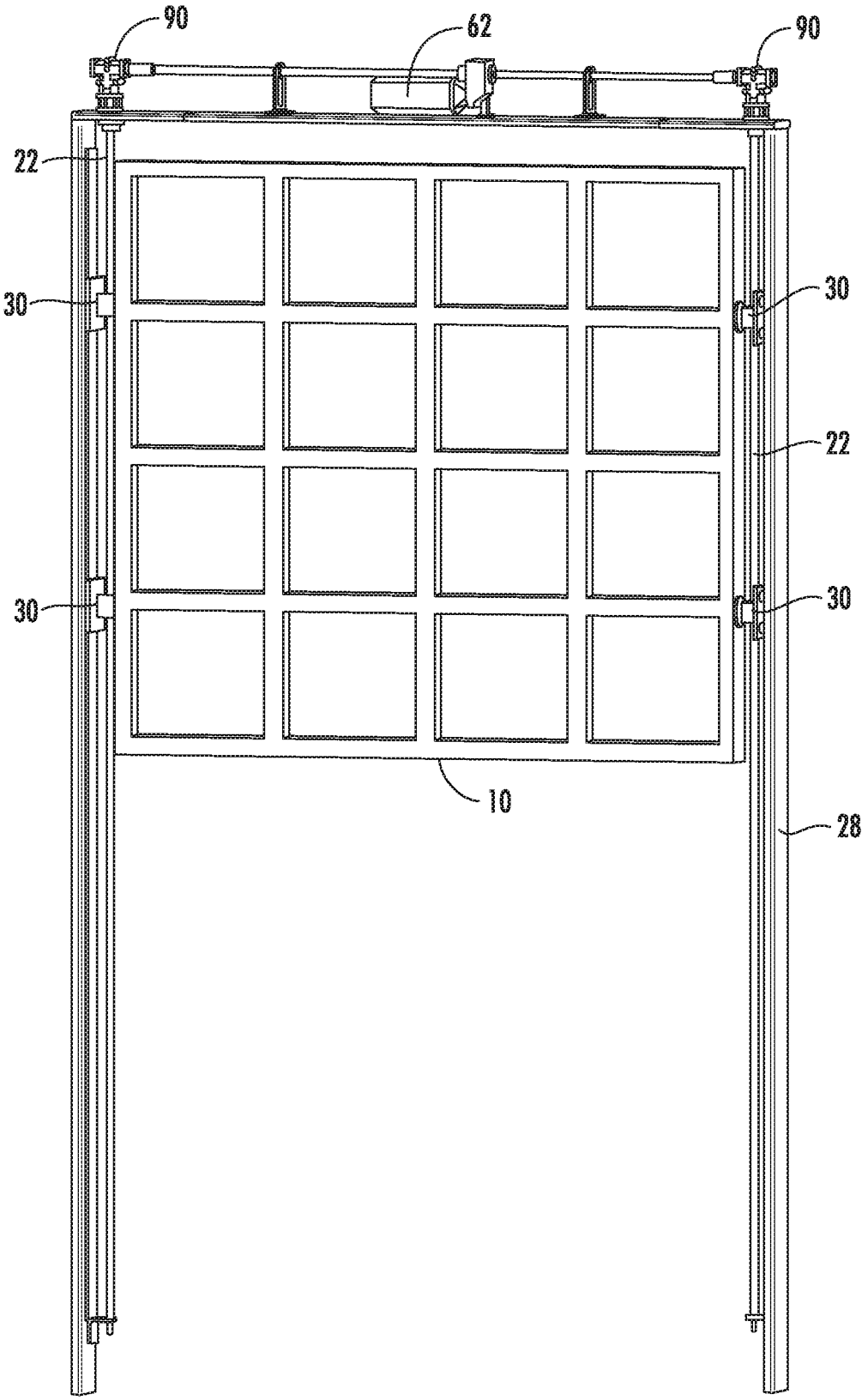
FIG. 4B2

VERTICAL DOOR SYSTEM WITH BALL SCREW DRIVE

CROSS-REFERENCE TO RELATED APPLICATION

This application claims benefit of U.S. Provisional Patent Application Ser. No. 62/357,761, filed on Jul. 1, 2016, the entirety of which is incorporated herein by reference.

FIELD OF THE INVENTION

The disclosed embodiments relate to a vertical door system. In particular, the disclosed embodiments relate to a vertical door system on which is mounted driven and non-driven blocks which are pivotally-attached to the door frame.

BACKGROUND OF THE INVENTION

Conventional vertical door systems use various mechanisms for operating the vertical door between opened and closed positions, such as cables, springs, lift straps, and hydraulic mechanisms. Such systems often employ counterweights which require additional space and which significantly increase the weight and installation time of the system. Furthermore, the failure of a lifting mechanism, such as a cable, can have catastrophic results.

SUMMARY OF THE INVENTION

According to a first aspect of the invention a vertical door system includes: a door, arranged in a door opening and having a door frame, the door frame having at least one frame section; an operator; two vertical supports configured to: (a) be installable on opposite sides of the door opening and (b) support the vertical door, at least one of the vertical supports having: a guide track on a surface of the vertical support facing toward the door opening; and a drive system comprising: an elongated threaded rod drivable by the operator via a gearing arranged between the operator and the threaded rod, the threaded rod being configured for operative connection with the operator for rotating the threaded rod about the longitudinal axis of the threaded rod in a first and a second direction, the longitudinal axis being vertically-oriented and parallel to the guide tracks; and one or more blocks, each of the one or more blocks comprising a guide track connecting portion configured to connect to one of the guide tracks so the connected block is freely movable along a respective one of the guide tracks, each block having a through-bore for accepting the threaded rod so that the block is positioned on the threaded rod and is movable along the threaded rod. Each of the one or more blocks comprises a door frame connecting portion arranged on a side of the block opposite the guide track connecting portion, each block being configured to pivotally connect to the vertical door by the door frame connecting portion. At least one of the one or more blocks comprises a drive nut configured to mate with threads of the threaded rod without rotating relative to the block or relative to the threaded rod, so that the block having the drive nut acts as a driven block which moves in an upward direction when the threaded rod rotates in the first direction and in a downward direction when the threaded rod rotates in the second direction.

In another aspect, the door frame includes only a single frame section, wherein movement of one or more driven blocks raises or lowers the single frame section, thereby opening or closing the vertical door.

In another aspect, the door frame includes a plurality of frame sections interconnected to one another by hinges.

In another aspect, each of the plurality of frame sections has a pair of connection members extending from opposite sides of the respective frame section, each connection member being configured to engage with the door frame connecting portion of one of the one or more blocks to form a pivotal connection thereto, wherein movement of one or more driven blocks raises or lowers a bottom-most frame section, to which the one or more driven blocks are connected, thereby opening or closing the vertical door.

In another aspect, the door system further includes: a three-way angle gear having an input shaft and a first output shaft interconnected to rotate synchronously with the input shaft, and a second, vertical output shaft connected to rotate synchronously with the input shaft and the first output shaft, wherein the operator comprises a motor which is oriented so that a rotor thereof rotates about a horizontal axis, the motor being operatively connected to the input shaft of the three-way angle gear to rotate the at least one threaded rod attached to the second output shaft of the three-way angle gear.

In another aspect, the operator comprises a motor which is oriented so that a rotor thereof rotates about a horizontal axis and both of the pair of vertical supports include the drive system and the guide track on a surface of the respective vertical support facing toward the door opening such that: first and a second vertical threaded rods are positioned, respectively, on opposite sides of the vertical door, the system further comprising: first and a second three-way angle gears, each having an input shaft and a first output shaft interconnected to rotate synchronously and a second, vertical output shaft connected to rotate synchronously with the input shaft and the first output shaft, wherein the motor is operatively connected to the input shaft of the first three-way angle gear to rotate the first vertical threaded rod attached to the second output shaft of the first three-way angle gear, and the first output shaft of the first three-way angle gear is connected to the input shaft of the second three-way angle gear by a horizontal drive shaft to rotate the second vertical threaded rod attached to the second output shaft of the second three-way angle gear.

In another aspect, the through-bore is configured as a guide bearing.

In another aspect, the guide track connecting portion configured to connect to one of the guide tracks comprises slider blocks configured to be slidable along the guide tracks.

In another aspect, the guide track connecting portion has two guide track attachment portions extending from the block and having vertically-oriented grooves configured to slidably couple with the guide track.

In another aspect, the guide track has two vertical guide rails and a common base portion attached to the support, wherein each of the vertical guide rails has a cross-section that includes a section of a circle and a portion that joins the common base portion, of the guide track, wherein the vertically-oriented grooves of the guide track attachment portions have a cross-section corresponding to the cross-section of the respective vertical guide rails so that the block is slidable along a length of the guide track but is prevented from becoming detached from the guide track due to forces transverse to an axial direction of the guide track.

In another aspect, the common base portion is attached to the support with fasteners or by welding.

In another aspect, the door frame connecting portion has a pivot pin hole configured to accommodate a connection member extending from one of the one or more frame sections.

In another aspect, an upper part of a highest frame section is coupled to the support by an arm.

In another aspect, the door frame comprises a thermally-broken frame having interior and exterior frame portions, and separator materials arranged therebetween to prevent temperature transfer through the door frame and to prevent resulting condensation on the interior frame portion, the door system further comprising: brush seals configured to block infiltration of unwanted pests; and a bulb seal configured to provide a seal at the perimeter of the door to block air and light.

In another aspect, the guide track connecting portion of the block comprises vertically-oriented grooved wheels which extend from a carriage arranged between the block and the guide track of the support tower, the vertically-oriented grooved wheels being configured to attach to the guide track, each grooved wheel having a circumferential groove configured to engage a section of guide rails of the guide track having a pointed angle edge.

In another aspect, the door system further includes: a three-way angle gear having an input shaft and one or more output shafts interconnected to rotate synchronously with the input shaft, wherein the operator comprises a motor which is oriented so that a rotor thereof rotates about a horizontal axis, the motor being coupled to a horizontal drive shaft, which is coupled to the input shaft of the three-way angle gear to rotate the at least one or more output shafts The vertical door system of the disclosed embodiments provides a quieter, more compact, more light-weight, and safer alternative to conventional vertical door designs which use springs, cables, straps, hydraulics, belts, counterweights and lift-pin slots. By using a combination of features described herein, e.g., a threaded ball screw powered by a heavy duty direct-drive operator such as a manual or electric motor, and moving slider blocks (both driven and non-driven) which are fastened with pivot pins to sections of the door frame, a vertical door system is provided that improves performance of prior art door systems of this type.

The disclosed embodiments provide a vertically-operated door system with a higher level of energy efficiency, as an alternative to conventional door designs which use unitary steel tube frames and single weather seals. By using a combination of features such as, for example, but not limited to, a thermally-broken frame, i.e., a frame construction that uses separator materials between interior and exterior portions of the door frame to prevent temperature transfer through the door frame and resulting condensation on the interior portion of the door frame, with or without brush seals, which, inter alia, prevent rodents from infiltrating the opening covered by the door, and a bulb seal, which enables a substantially complete seal at the perimeter to block air and light, with or without insulated foam sections enhancing the thermal performance of the door frame for both heat and cooling. Significant performance enhancement can be achieved over conventional vertical door designs. The thermal efficiencies gained from the use of, but not limited to, these three components, i.e., the thermally-broken frame, bulb seal, and brush seal, provide a higher level of energy efficiency over conventional approaches and thereby enable the end user to spend less on energy while providing a more comfortable environment.

In one aspect, the disclosed embodiments provide a vertical door system, comprising: a pair of vertical supports configured to be installed on opposite sides of a door opening to support the vertical door, each of the vertical supports having a guide track with or without cam rollers and/or sliding rails on a surface thereof facing toward the door opening; a drive system comprising at least one elongated threaded rod and an operator, such as a manual or electric motor. The motor is configured for operative connection to rotate the threaded rod about its longitudinal axis of the threaded rod in a first and a second direction. The longitudinal axis is vertically-oriented and parallel to the guide tracks.

A plurality of blocks, each comprising a guide track connecting portion configured to connect to one of the guide tracks so the connected block is freely movable along a respective one of the guide tracks. The blocks have a through-bore for accepting the threaded rod so each block is positioned on the rod and is freely movable. A door frame connecting portion is provided on a side of each block opposite the guide track connecting portion and is configured to pivotally connect to the vertical door. At least one of the plurality of blocks comprises a drive nut configured to mate with threads of the rod without rotating so the block acts as a driven block which moves in an upward direction when the threaded rod rotates in the first direction and in a downward direction when the threaded rod rotates in the second direction.

A door comprising a frame having a single frame section, or a plurality of frame sections interconnected by hinges is provided. Each of the frame sections has a pair of connection members extending from opposite sides thereof which are each configured to engage with one of the door frame connecting portions of the plurality of blocks to form a pivotal connection to a respective one of the plurality of blocks. Movement of the at least one driven block raises or lowers the single frame section, or a bottom-most frame section, to which the driven block is connected, thereby opening or closing the vertical door.

Particular embodiments may include one or more of the following features:

A three-way angle gear having an input shaft and a first output shaft interconnected to rotate synchronously and a second, vertical output shaft connected to rotate synchronously with the input shaft and the first output shaft, wherein: the motor is oriented so that a rotor thereof rotates about a horizontal axis, the motor being operatively connected to the input shaft of the three-way angle gear to rotate the at least one threaded rod which is attached to the second output shaft of the three-way angle gear.

The system may further comprise: a first and a second vertical threaded rod positioned on opposite sides of the vertical door; and a first and a second three-way angle gear, each having an input shaft and a first output shaft interconnected to rotate synchronously and a second, vertical output shaft connected to rotate synchronously with the input shaft and the first output shaft, wherein: the motor is oriented so that a rotor thereof rotates about a horizontal axis, the motor being operatively connected to the input shaft of the first three-way angle gear to rotate the first vertical threaded rod which is attached to the second output shaft of the first three-way angle gear, and the first output shaft of the first three-way angle gear is connected to the input shaft of the second three-way angle gear by a horizontal drive shaft to rotate the second vertical threaded rod which is attached to the second output shaft of the second three-way angle gear.

BRIEF DESCRIPTION OF THE DRAWINGS

The above and/or other aspects and advantages will become more apparent and more readily appreciated from the following detailed description of the disclosed embodiments taken in conjunction with the accompanying drawings in which:

FIG. 4A1 shows schematic views of a single-panel vertical door in a closed position, a partially-open position, and a fully-open position;

FIG. 4A2 is a view of a single-panel vertical door of FIG. 4A2 in a closed position, showing the drive system;

FIG. 4B1 shows schematic views of another embodiment of a single-panel vertical door in a closed position, a partially-open position, and a fully-open position;

FIG. 4B2 is a view of a single-panel vertical door of FIG. 4B1 showing the drive system;

DETAILED DESCRIPTION

Figure 1:
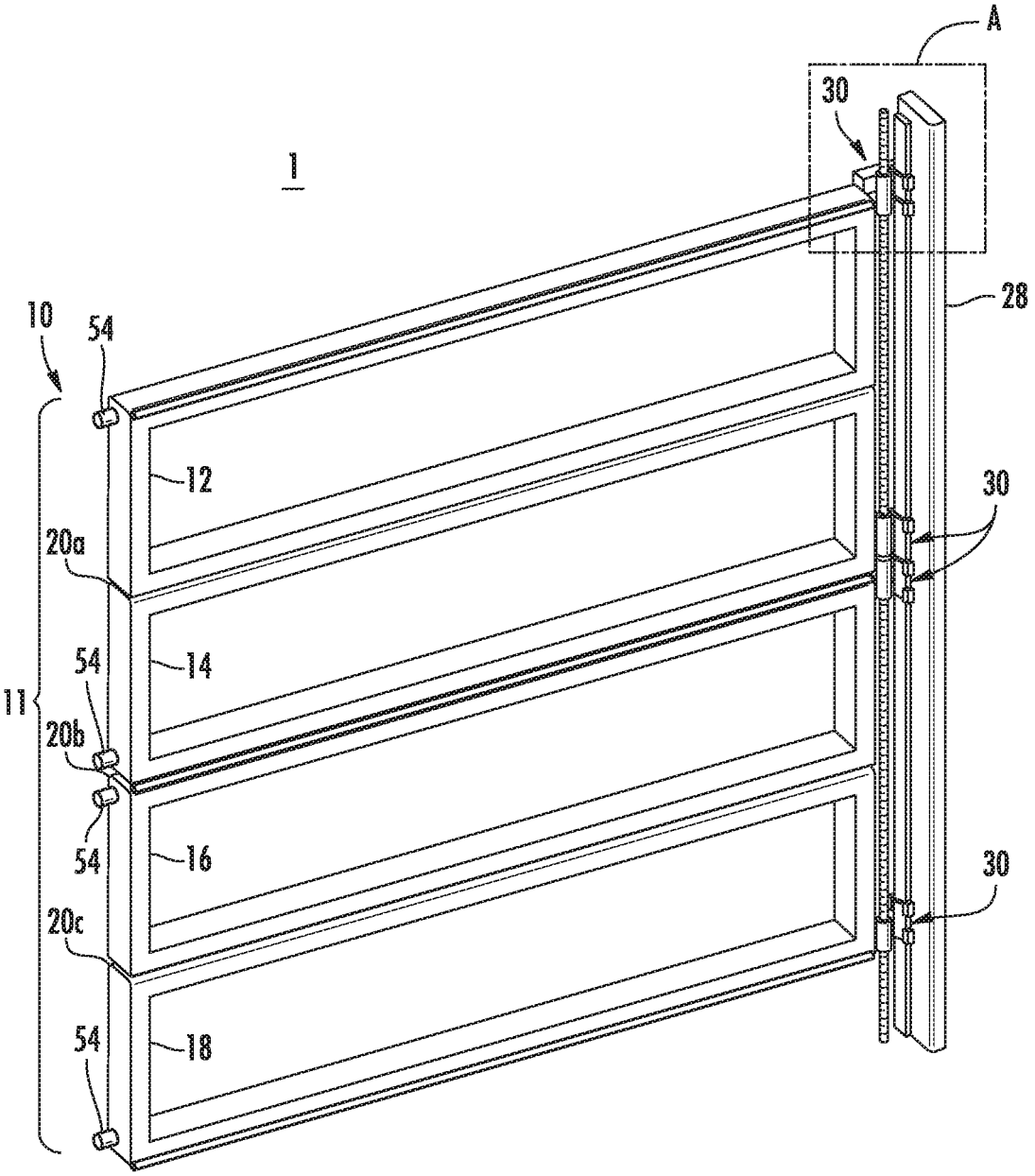
FIG. 1 is a partial view of a quad-panel vertical door system.

FIG. 1 is a partial view of a quad-panel vertical door system 1. In the system 1, a door 10 is formed from a frame 11 with four frame sections 12, 14, 16, and 18, which are joined by hinges 20*a*, 20*b*, and 20*c*. The door is configured to open in an upward vertical direction as the frame sections fold together (see, e.g., FIG. 6, discussed below). In particular embodiments, each section of the frame 11 has a panel of insulated glass. The frame 11 is connected to a drive system 13, which will be described in detail below. It is noted that in FIG. 1 for illustration purposes the drive system 13 is shown on the right side of the door. It will be appreciated by those of ordinary skill that the drive system can likewise be positioned only on the left side of the door, or on both sides of the door, depending on the application.

Each of the frame sections 12, 14, 16, and 18 has a pair of connection members (i.e., pivot pins) 54 extending from opposite sides thereof which are each configured to engage pivotally with one of the plurality of blocks 30 to form a pivotal connection therewith. In FIG. 1, the pivot pins 54 are visible on the left side because the drive system 13 is not shown on that side of the figure. Such pivot pins 54 also extend from the frame 11 on the right side, and extend into the block 30, but are not visible in this figure.

The blocks 30 can be of two types: "driven" and "non-driven." A "driven" block 30 is configured such that its movement raises or lowers the single frame section, or a bottom-most frame section, to which the driven block is connected, thereby opening or closing the vertical door. In contrast, a non-driven block provides a slidable connection between the door 10 and the drive system 13, but does not positively engage the drive system 13 to contribute to the lifting force provided to the door.

Figure 2:
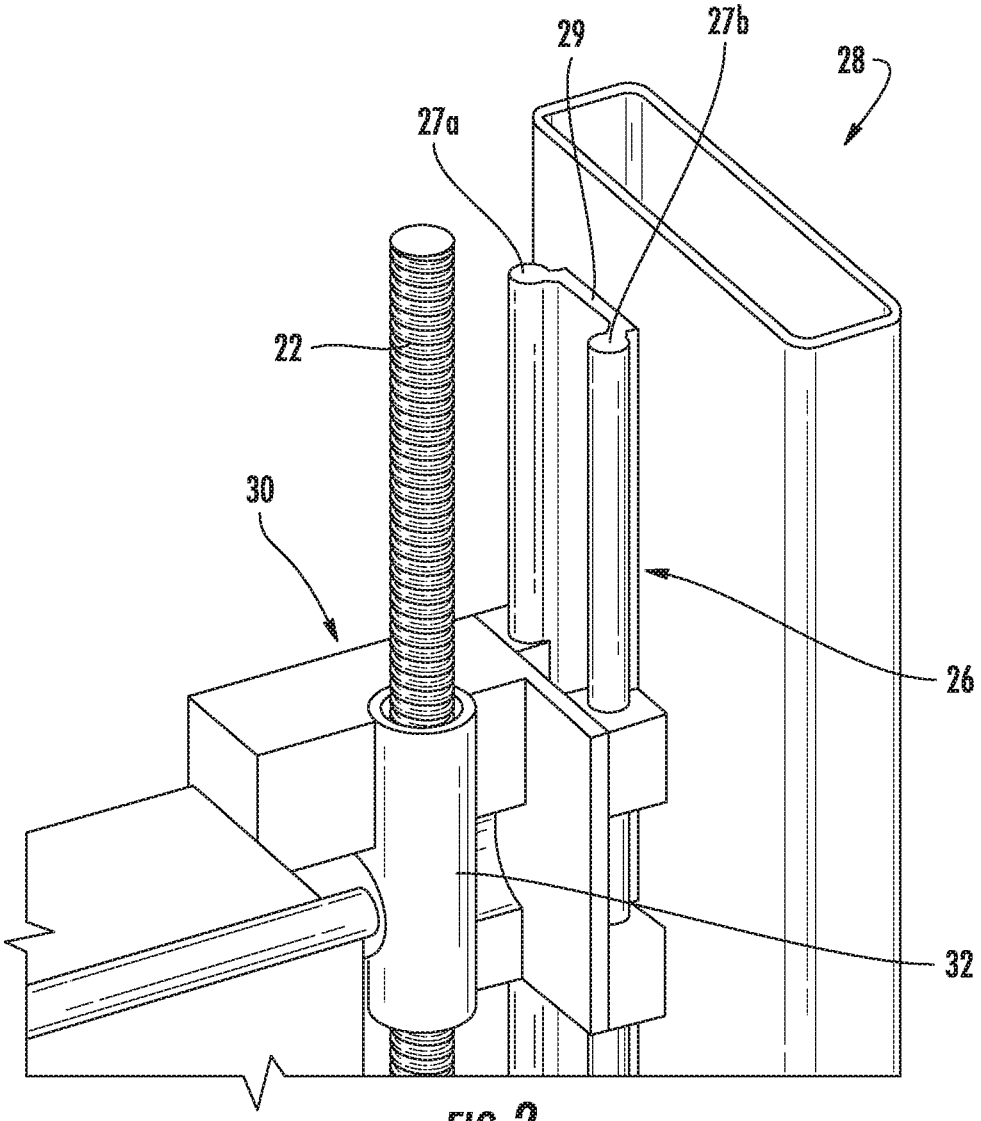
FIG. 2 is an enlarged view of a portion of the ball screw drive system of the vertical door system depicted in FIG. 1.

FIG. 2 shows an enlarged view of the portion "A" of the ball screw drive system 13 of the vertical door system 1 depicted in FIG. 1. The drive system 13 uses a ball screw 22, which is an elongated metal rod with screw threads 24 along its length.

Figure 3:
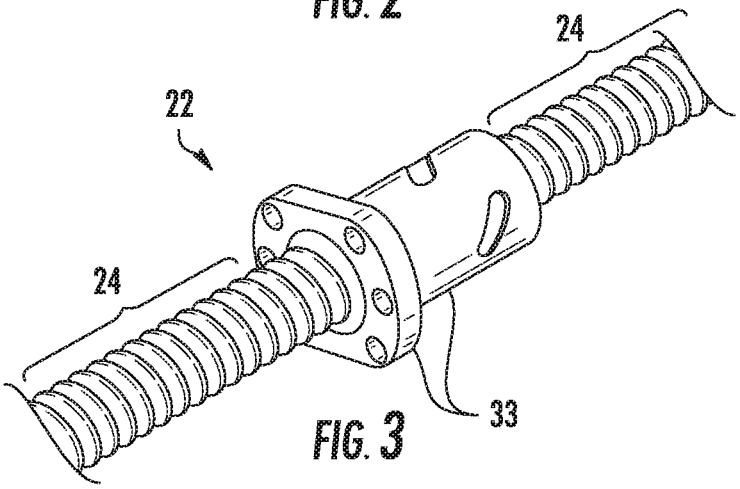
FIG. 3 is an enlarged view of a ball screw driveshaft with a drive nut installed thereon.

FIG. 3 depicts an enlarged view of a ball screw, or ball screw driveshaft 22, illustrating the screw threads 24 of the ball screw 22, with a drive nut 33 installed thereon in threaded engagement with the ball screw 22.

The drive nut 33 is installed in a driven block 30, typically deployed at a bottom frame section of the frame 11, so that the driven block 30 threadingly positively engages the threads of the ball screw 22 upon rotation of the ball screw 22. As the ball screw 22 is rotated, the drive nut 33, and the driven block 30 in which it is installed, move linearly along the ball screw 22 in either of two opposite directions, depending upon the direction of rotation, e.g., clockwise or counterclockwise.

The ball screw 22 may be formed, for example, of steel and may have a diameter of about 25 mm which could result in a rating for a dynamic load of 6,500 pounds or a static load of 16,000 pounds.

Referring again to FIG. 2, the ball screw 22 operates in conjunction with a guide track 26 attached to an outer frame of the door system 1, i.e., a support tower 28. As can be seen in FIGS. 1 and 2, a block 30 is configured to be attached to the guide track 26 so that the block 30 can move vertically along the guide track 26 in an up or down direction.

The guide track 26 has vertical members, i.e., guide rails 27*a* and 27*b*, which have a cross-section which includes a section of a circle and a portion that joins a flat portion, i.e., the base portion 29, of the guide track 26. The base portion 29 attaches to the support tower 28, e.g., with fasteners or by welding. The block 30 includes a guide bearing 32 through which the ball screw 22 extends, thereby allowing the block 30 to move vertically along the ball screw 22 in an up or down direction.

If the block is configured as a driven block, i.e., a block that is driven by the rotational movement of the ball screw 22, the block 30 will include a drive nut 33 instead of the guide bearing 32. On the other hand, if the block is a non-driven block then the hole in the guide bearing 32 that receives the ball screw 22 will have a smooth bore or, in any event, a bore that does not engage the threads 24, so that threading engagement does not occur between the non-driven block and the ball screw 22. Rather, free vertical movement of the non-driven block 30 along the ball screw 22 may occur, by the sliding connection formed between the non-driven block 30 and the guide track 26.

The block 30 is also pivotally attached to particular points, i.e., connection members/pivot pins 54, on the doorframe 11, e.g., to the top or bottom of each frame section 12, 14, 16, 18. Because the connection members 54 engage a pivot hole in the corresponding block 30, the connection members are only visible at the left side of FIG. 1, i.e., the figure that does not show the drive system 13 on that side.

As a result of this configuration, the connected portions of the frame sections 12, 14, 16, 18 of the door 10 can move vertically along the ball screw 22. As discussed in further detail below, a bottom-most one of the blocks 30 is a driven block, which is connected to the ball screw 22 with a drive nut 33, which threadingly engages the screw threads 24 of the ball screw 22, allowing rotation of the ball screw 22 to lift and lower the driven block 30, and hence the bottom of the doorframe 11, in a vertical direction as the ball screw 22 rotates.

FIGS. 4A1, 4B1, 5 and 6 are schematic illustrations showing doors having different numbers of frame sections. For clarity of illustration of this aspect of the invention, the details of the drive system 13 are not illustrated in FIGS. 4A1, 4B1, 5 and 6. FIG. 4A2 shows portions of the drive system 13 for a single-panel folding door. FIG. 4B2 similarly shows portions of the drive system 13.

FIG. 4A1 provides schematic views of a rotating single-panel vertical door in a closed position, a partially-open position, and a fully-open position, respective, from left to right in the figure. The single-panel doorframe, unlike multiple-panel door frame, goes through a rotation as it is opened, rather than folding onto itself. In this particular embodiment, the doorframe 11 is connected to the drive system 13 at two points along a vertical extent of the frame 11. Specifically, the door frame 11 is connected to the drive system 13 (not shown in detail in this figure) at a midpoint 34 of the frame 11 in the vertical direction and at a point which is one quarter of the length of the door frame 11 from the top of the doorframe 11. This upper point is connected to the drive system 13 through a lever arm 36, which is connected to the top of the system support frame "tower" 28.

This arrangement of connections leaves the top of the door frame 11 unattached to the drive system 13. Therefore, as the door 10 rises in the vertically-upward direction, the unattached top of the door frame 11, and the unattached bottom of the door frame 11, will move in opposite outward directions relative to a plane of the doorframe 11, whereas the attached portion (i.e., at the midpoint 34 of the door frame 11) will remain in the plane of the doorframe 11 as the door 10 moves upward, as the driven block coupled at the midpoint 34 (not shown in the figure) is driven upward.

FIG. 4A2 is a detailed figure that shows how the drive system is arranged in the single panel vertical door that is shown schematically in FIG. 4A1. As can be seen in FIG. 4A2, at each side of the door 10, at the midpoint 34, a driven block 30 is pivotally coupled to the door 10, slidably coupled to the guide track 26 attached to an outer frame of the door system 1, i.e., the support tower 28, and threadingly coupled to the ball screw 22 so that the block 30 can move vertically along the guide track 26 in an up or down direction, while allowing the door to pivot at the midpoint 34.

FIG. 4B1 is a schematic view of a non-rotating single-panel vertical lift door in a closed position, a partially-open position, and a fully-open position. Unlike multiple-panel door frames that fold and/or single-panel canopy door frames that tilt and rotate, the single-panel vertical lift doorframe shown in FIG. 4B1, only rises and lowers in the plane of the doorframe 11. In this particular embodiment, the doorframe is connected to the drive system at two points along a vertical extent of the frame. Specifically, the single frame section is connected to the drive system at an upper point which is spaced below the top of the frame section by a distance which is one quarter of the length of the door frame section.

The second connection between the doorframe and the drive system is at a lower point which is spaced above the bottom of the frame section by a distance which is one quarter of the length of the frame section. Both these connection points are connected directly to the drive system which has a total vertical length preferably minimally twice the total height of the single frame section. This arrangement of connections allows the door to travel in the plane of the doorframe as it is opened in the vertically-upward direction, and closed in the vertically-downward direction.

FIG. 4B2 is a view of a single-panel vertical door of FIG. 4B1 showing the above-mentioned connections to the drive system. FIG. 4B2 is a detailed figure that shows how the drive system is arranged in the single panel vertical door that is shown schematically in FIG. 4B1. As can be seen in FIG. 4B2, at each side of the door 10, two blocks 30 are coupled to the door 10, slidably coupled to the guide track 26 (not visible in this figure) that is attached to an outer frame of the door system 1, i.e., the support tower 28, and coupled to the ball screw 22 so that the block 30 can move vertically along the guide track 26 in an up or down direction. Unlike the door shown in FIGS. 4A1 and 4A2, the door in FIGS. 4B1 and 4B2 slides only in the plane of the doorframe 11.

As discussed above, the single frame section is connected to the drive system, via blocks 30, at an upper point on each side of the door, the upper point being spaced below the top of the frame section by a distance which is one quarter of the length of the door frame section.

The second connection between the doorframe and the drive system is also via blocks 30, at a lower point, on each side of the door, which is spaced above the bottom of the frame section by a distance which is one quarter of the length of the frame section. Both these connection points are connected directly to the drive system which has a total vertical length preferably minimally twice the total height of the single frame section. This arrangement of connections allows the door to travel in the plane of the doorframe as it is opened in the vertically-upward direction, and closed in the vertically-downward direction. As can be seen in FIG. 4B2, the drive system has preferably four blocks 30, two on each side at the heights discussed above. At least one block 30 on each side is a driven block 30.

Figure 5:
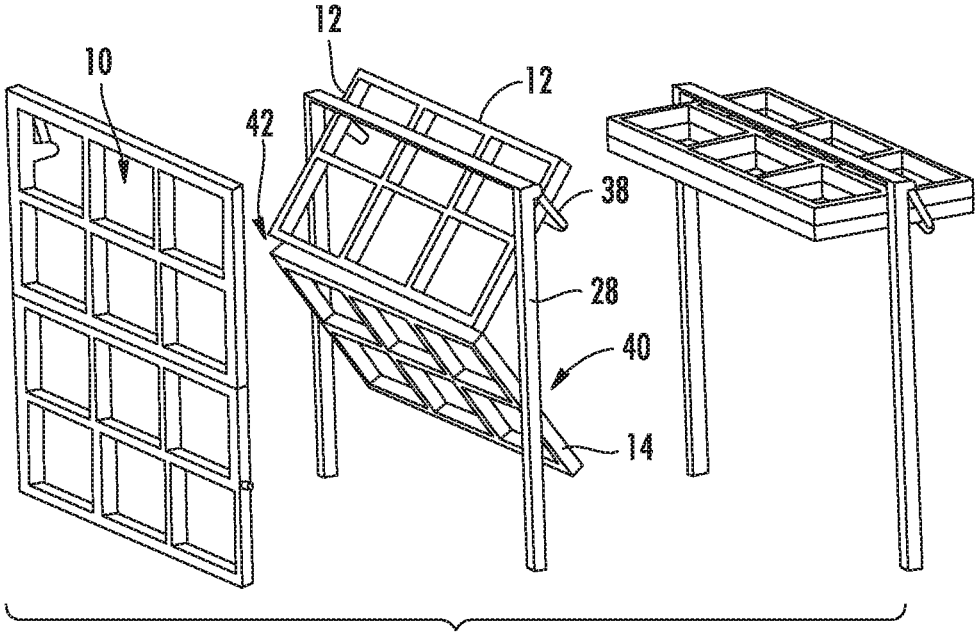
FIG. 5 shows schematic views of a dual-panel vertical door in a closed position, a partially-open position, and a fully-open position.

FIG. 5 provides schematic views of a dual-panel vertical door in a closed position, a partially-open position, and a fully-open position, respectively, from left to right in the figure. In this particular embodiment, because the door 10 has two frame sections 12 and 14, the frame 11 is connected to the drive system 13 (not shown in detail in this figure) at two points along a vertical extent of the frame 11. Specifically, considering the upper-most frame section to be the first frame section 12, the first frame section 12 is connected to the drive system 13 at an upper point which is spaced below the top of the first frame section 12 by a distance which is one quarter of the length of the first frame section 12. This upper point is connected to the drive system 13 through a lever arm 38, which is connected to the top of the system support frame (tower) 28. The second connection between the doorframe 11 and the drive system 13 is at a midpoint 40 of the second frame section 14 in the vertical direction. This connection is achieved by the pin 54 engaging a driven block 30 (not visible) at midpoint 40. This arrangement of connections leaves a hinge 42 between the first frame section 12 and the second frame section 14 unattached to the drive system 13. Therefore, as the door 10 folds as it is opened in the vertically-upward direction, the unattached hinge 42 will move in an outward direction relative to a plane of the doorframe 11 in the closed position. The unattached top of the door frame 11, and the unattached bottom of the door frame 11, will move outward relative to a plane of the doorframe in a direction opposite to the direction of outward movement of the hinge 42, while the pin 54 at the midpoint 40, being arranged in the block 30 (not visible in this figure) arranged at the midpoint 40 ensures that the part of the door at the midpoint 40 moves only within the plane of the frame 11.

Figure 6:
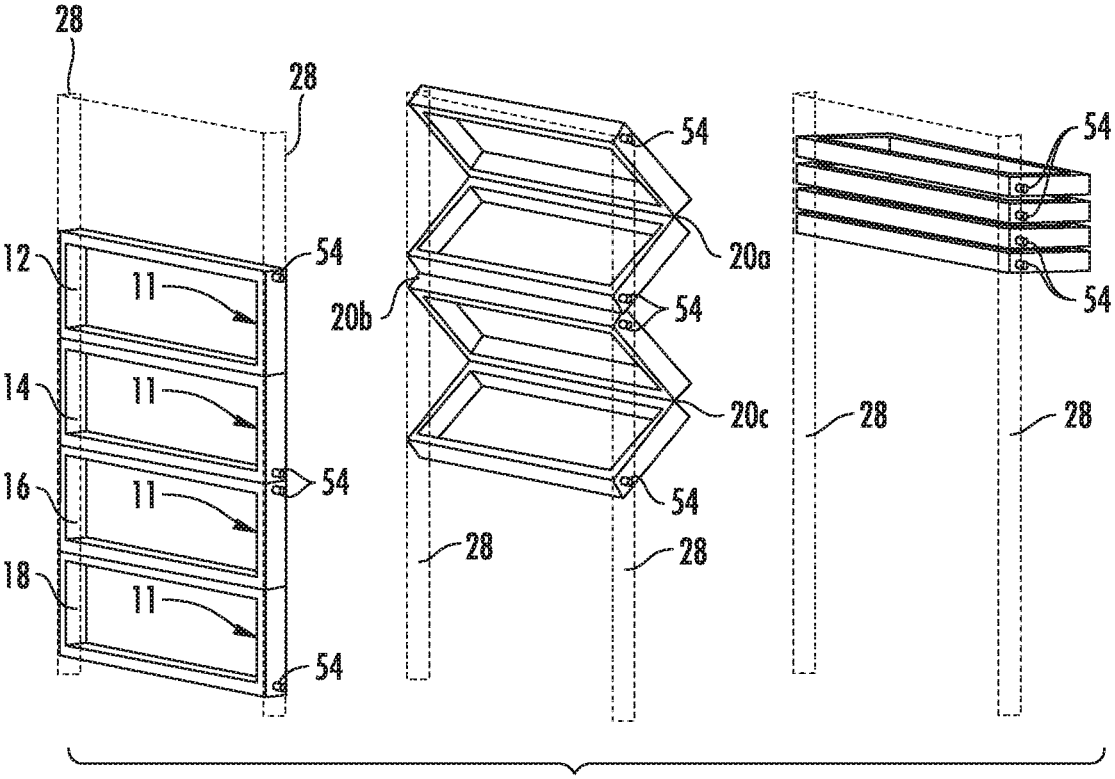
FIG. 6 shows schematic views of a quad-panel vertical door in a closed position, a partially-open position, and a fully-open position.

FIG. 6 provides schematic views of a quad-panel vertical door in a closed position, a partially-open position, and a fully-open position, respectively, from left to right in the figure. In this particular embodiment, because the door has four frame sections, as in FIG. 1, the frame 11 is connected to the drive system 13 (not shown in detail in this figure) at four points along a vertical extent of the frame 11. Specifically, considering the upper-most frame section to be the first frame section 12, the frame 11 is connected to the drive system 13: at the top of the first frame section 12; at the bottom of the second frame section 14; at the top of the third frame section 16; and at the bottom of the fourth frame section 18. A drive system 13, such as the one illustrated in FIGS. 1 and 2, would be used to drive the quad-panel vertical door of FIG. 6.

This arrangement of connections leaves a hinge 20*a* between the first frame section 12 and the second frame section 14, and a hinge 20*c* between the third frame section 16 and the fourth frame section 18, unattached to the drive system 13. Therefore, as the door 10 folds as it is opened in the vertically-upward direction, the unattached hinges 20*a* and 20*c* will move in an outward direction relative to a plane of the doorframe in the closed position, whereas an attached hinge 20*b* (i.e., the hinge between the second frame section 14 and the third frame section 16), and the top and bottom edges of the frame 11, will remain in the plane of the doorframe (in the closed position) as they move upward.

Figure 7A:
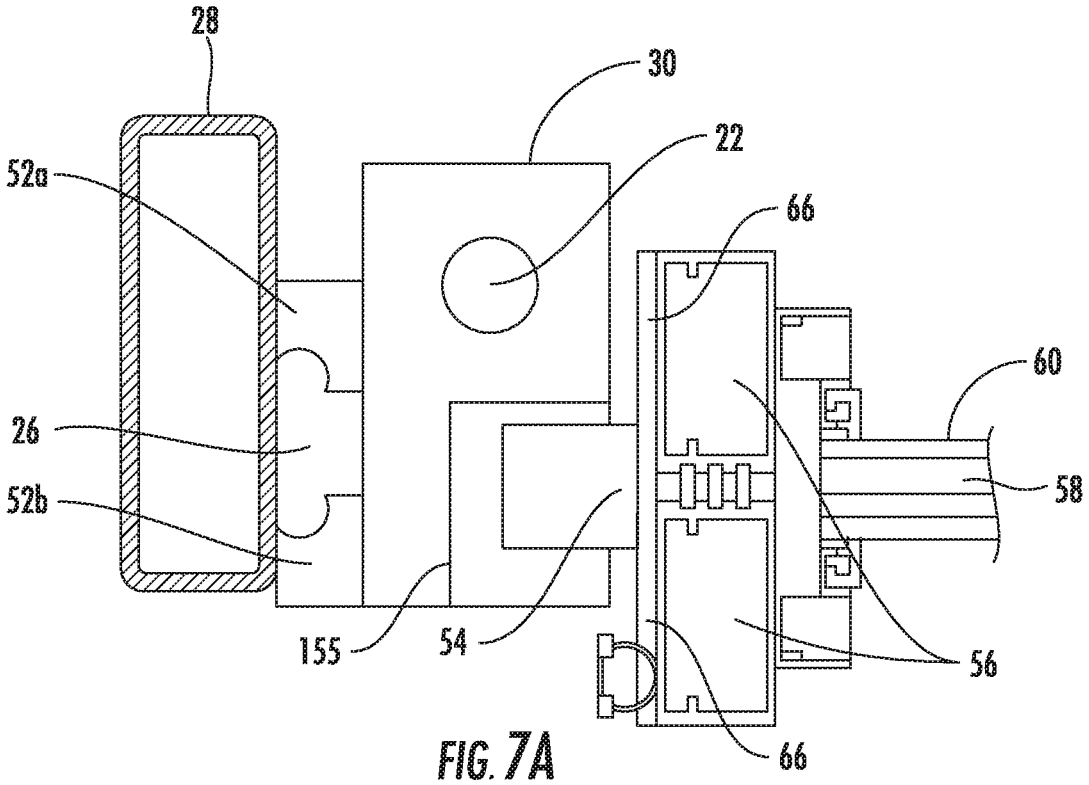
FIG. 7A is a partial top schematic view of a vertical door system, including a portion of a ball screw drive system.

FIG. 7A is a partial top schematic view of a vertical door system 1, including a portion of a ball screw drive system 13. In the drive system 13, the ball screw 22 operates in conjunction with a guide track 26 attached to a frame, i.e., a support tower 28, which may be, for example, a structural steel tube. A movable member, e.g., a pivot block assembly 30, is slidably coupled, using slider blocks 52*a* and 52*b*, with the guide track 26 so that the block 30 can move vertically along the guide track 26 in an up or down direction. The block 30 includes a guide bearing 32 through which the ball screw 22 extends, thereby allowing the block 30 to move vertically along the ball screw 22 in an up or down direction.

The block 30 is also pivotally attached, e.g., via a pivot pin 54, which rotates inside the pivot block assembly, to particular points on the doorframe, e.g., to the top or bottom of each frame section. As can be seen in the figure, the pivot pin 54 comes out of the frame 11 and enters block 30 in a hole 72, more easily seen in FIG. 11 to be discussed below. The hole 72 is in a pivot block cover 155 that forms a structural part of the pivot block 30, and can also be seen in FIGS. 10 and 11.

The doorframe 11 may be configured to include a thermal break 56 between an interior facing side and exterior facing side. Glass, or some other material 58, may be installed in the frame and isolated by an insulating member 60.

Figure 7B:
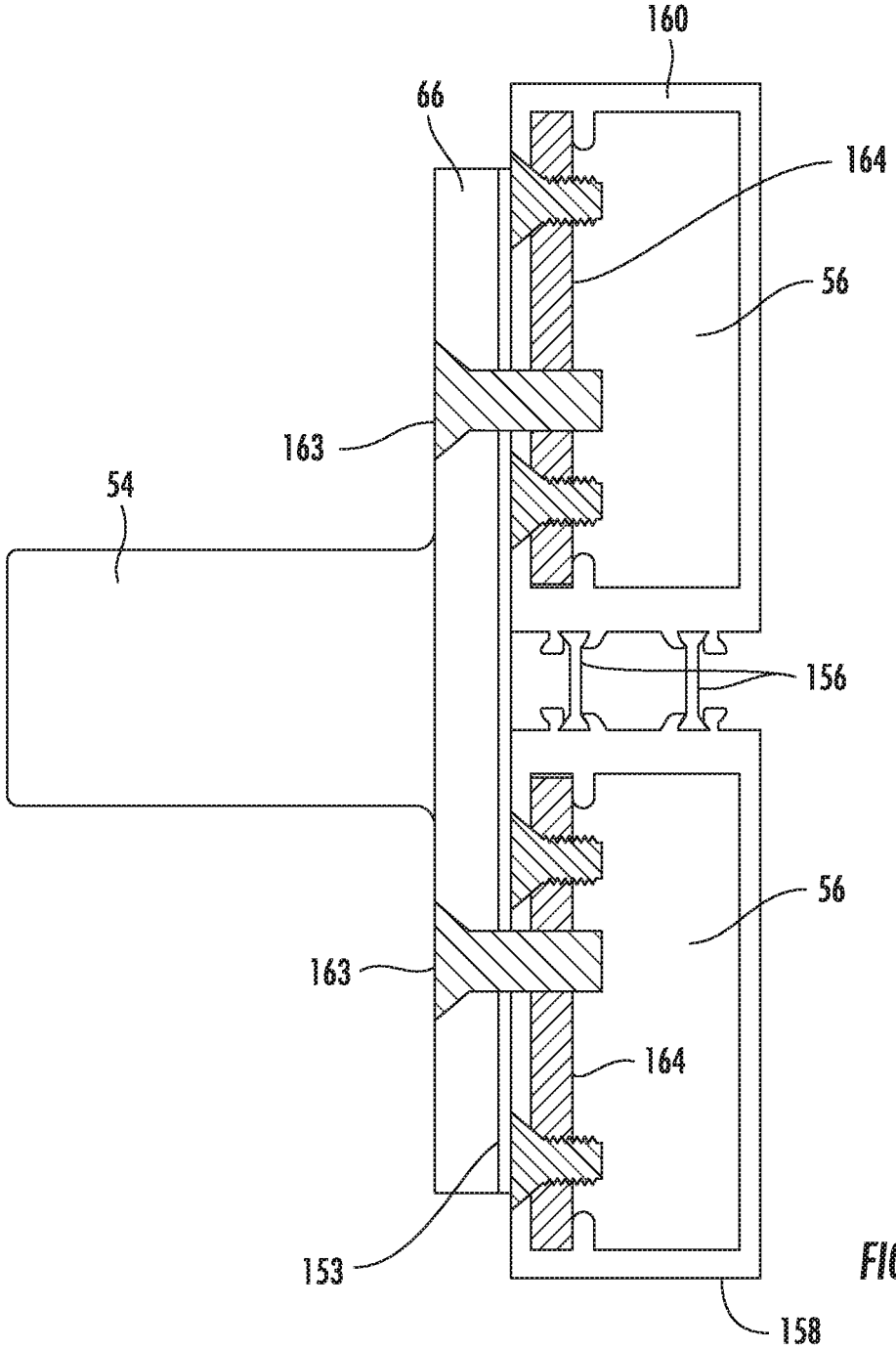
FIG. 7B is a detailed view of the pivot pin in conjunction with the side of the door frame.

FIG. 7B shows functions of the broken frame structure. The pivot pin 54 extends from the pivot plate 66. A thermal isolation pad 153 is arranged between the pivot plate 66 and the side of the frame 11 closest to the rail. This provides thermal isolation between the door and the pivot plate 66. Screws 163 are preferably used to affix the pivot plate 66 to a steel flat portion 164 arranged inside each portion of the door frame 11. The two portions of the broken door frame 11 are separated by non-conductive polymeric connectors 156, which function to disrupt temperature transfer from metal to metal, i.e., from one section of the door frame to another.

In particular, the non-conductive polymeric connectors 156 can help to prevent temperature transfer between the exterior side 160 of the frame 11, which is exposed to outside temperature, and the interior side 158 of the frame 11, which is exposed to inside temperature.

Figure 7C:
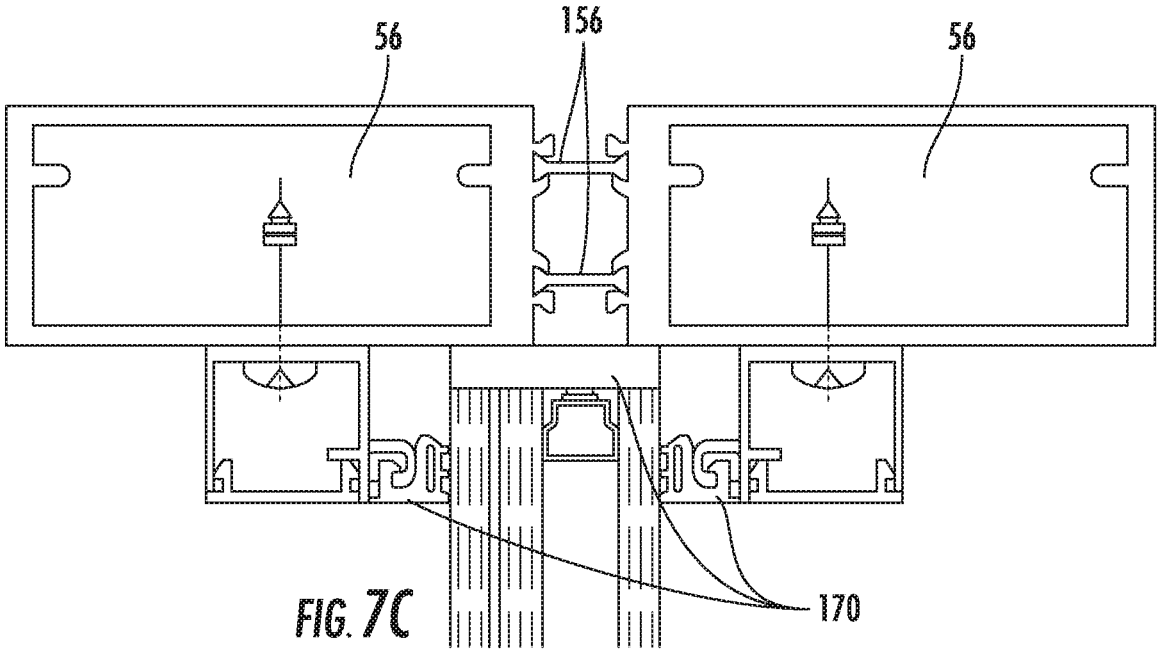
FIG. 7C shows further thermal insulation structures.

As shown in FIG. 7A, glass, or some other material 58, may be installed in the frame and isolated by an insulating member 60. FIG. 7C shows the location of further insulating members 170 that provide additional insulation.

Figure 8:
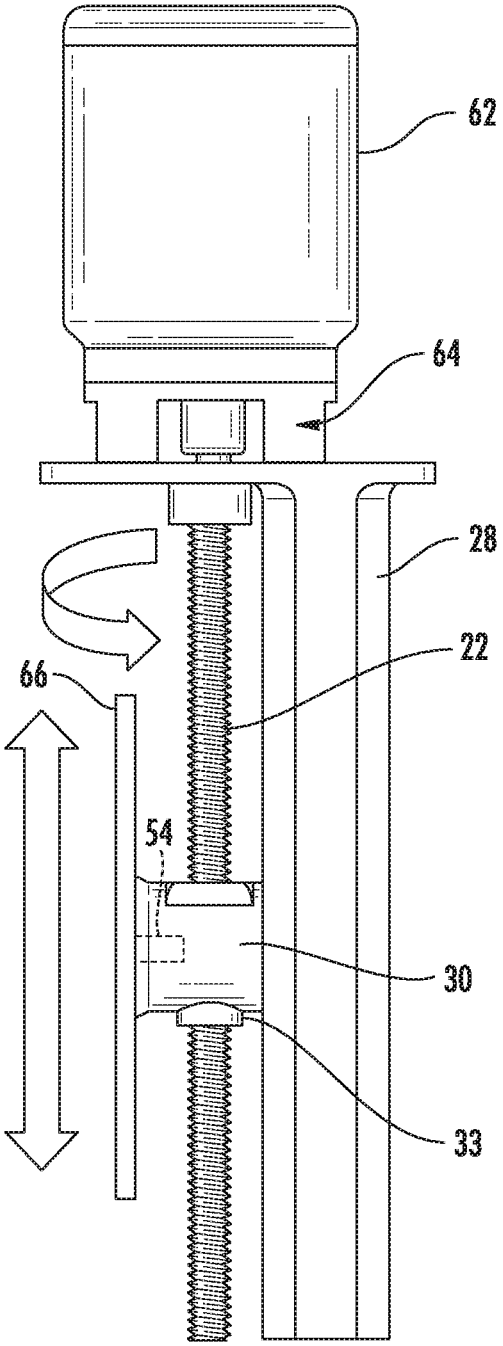
FIGS. 8 and 9 are partial side schematic views of a ball screw drive system with a direct drive motor.
Figure 9:
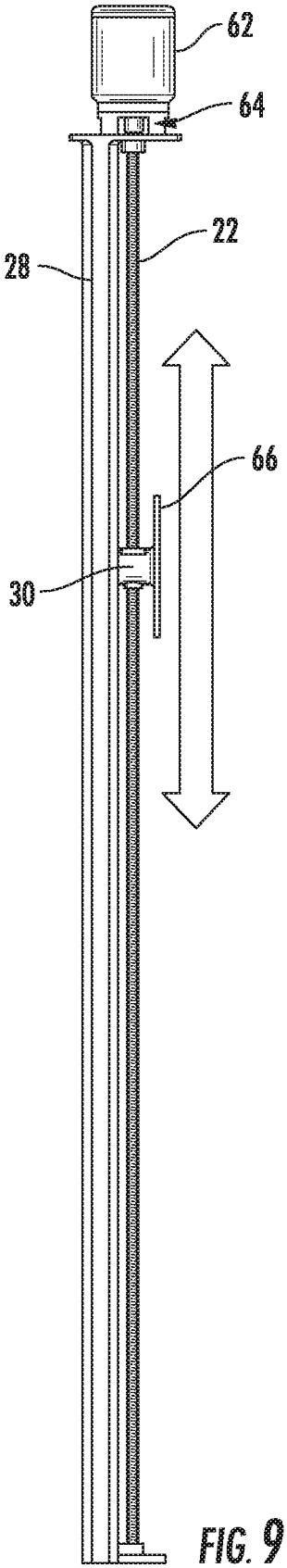

FIGS. 8 and 9 are partial side schematic views of a ball screw drive system 13 with a direct drive motor 62. As discussed above, the drive system 13 includes a block 30 mounted on a ball screw 22. The block 30 may, if it is a driven block, include a ball screw drive nut 33 having a threaded interior portion which is configured to interlock with the threads 24 (not visible in FIGS. 8 and 9) of the ball screw 22, thereby resulting in linear motion of the ball screw drive nut 33, and the block 30, along the ball screw 22 as the ball screw 22 rotates.

In this manner, the rotation of the ball screw 22 about a vertically-oriented axis results in vertical linear motion of the pivot block 30. The rotation of the ball screw 22 may be provided by a directly coupled motor 62 having a rotor coupler 64 which is, in the illustrated embodiment, positioned to rotate about a vertically-oriented axis and which is coupled to the ball screw 22. The rotor coupler 64 couples with a motor drive shaft and a gear box that provides direct drive to the ball screw 22. That is, the present invention uses a direct drive system where the motor drive shaft rotates the screw drive via gear boxes. Note that the gear boxes may effect a change in direction, such as by bevel gears 100, as discussed below in relation to a horizontally mounted motor configuration.

A door mounted pivot plate 66 is provided to attach the block 30 to the door frame 11. The pivot pin 54, preferably made of steel, extends from the pivot plate 66 into the hole 72 of the block 30, which hole 72 is shown clearly in FIGS. 10 and 11. The hole 72 is preferably lined with a pivot pin sleeve 174, discussed below with reference to FIGS. 10 and 11. The pivot pin 54 is preferably integrally formed together with the pivot plate 66, but the invention is not limited to this configuration and the pivot pin 54 could be coupled to the pivot plate by other methods, for example, by soldering, welding, etc. A block 30 that has a screw drive nut 33, the bottom portion of which is visible in FIG. 8, is a driven block, in that such a block 30 having the screw drive nut 33 threadingly couples with the threads 24 of the ball screw 22, which coupling applies a driving force, up or down, upon rotation of the threads 24 of the ball screw 22.

Figure 10:
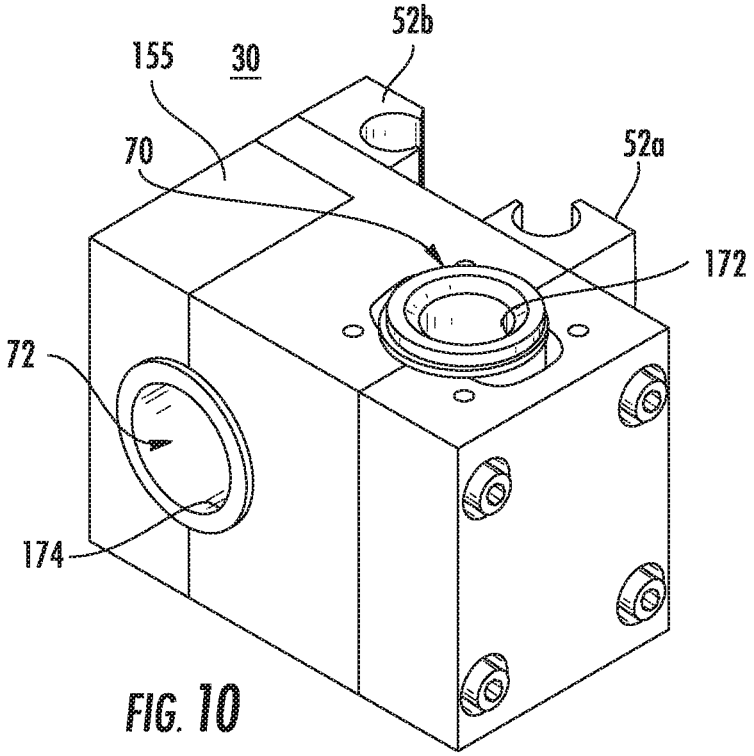
FIGS. 10 and 11 are isometric views of an upper, non-driven pivot block for a ball screw driveshaft.
Figure 11:
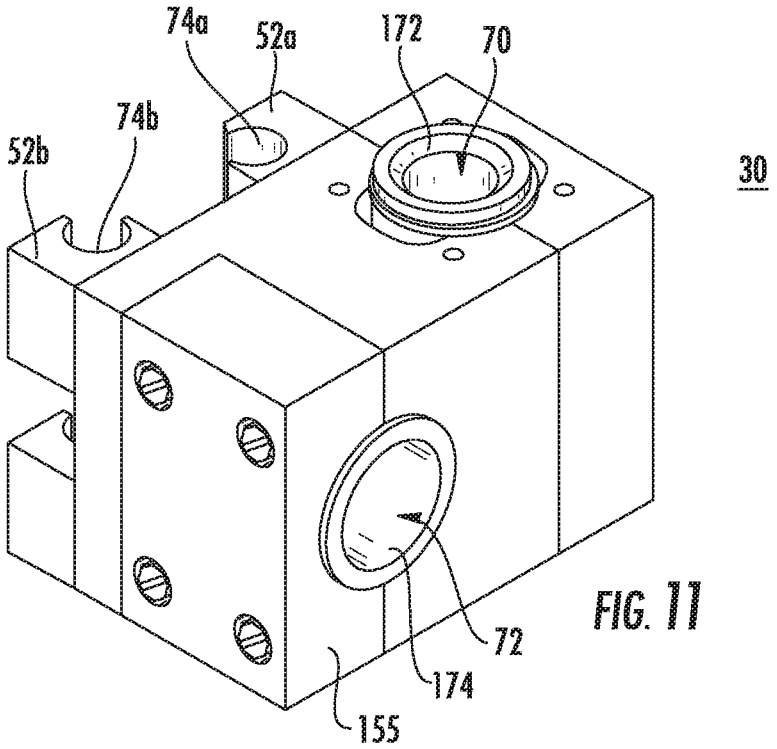

FIGS. 10 and 11 are isometric views of an upper, non-driven block 30 for a ball screw driveshaft 22. Rather than receiving the ball screw with a drive nut 33, the pivot block 30 in this figure has a hole 70, for example a smooth-bore hole, which is configured to receive the ball screw 70, but to allow the block 30 to move freely in a linear direction along the ball screw 22 without engaging with the threads 24 of the ball screw 22. The hole 70 has an associated Delrin ball screw guide bushing that lines the hole. Because the threads of the ball screw 22 do not threadingly engage with the pivot block 30, this pivot block 30 is considered to be non-driven block, as no linear force is applied to this pivot block 30 by the threads 24 of the ball screw 22 during rotation of the ball screw 22.

The pivot block 30 has two guide track attachment portions 52*a* and 52*b* which extend from the block 30 and which have vertically-oriented grooves 74*a* and 74*b*, respectively, which are configured to attach to the guide track 26. In this particular embodiment, the guide track 26, as shown in FIG. 2, has vertical members, i.e., guide rails 27*a* and 27*b*, with each having a cross-section which includes a section of a circle and a portion that joins a flat portion, i.e., the base portion 29, of the guide track 26. The base portion 29 of the guide track 26 attaches to the support tower 28, e.g., with fasteners or by welding. The grooves 74*a* and 74*b* of the guide track attachment portions 52*a* and 52*b*, respectively, have a cross-section corresponding to the cross-section of the respective guide rails 27*a* and 27*b*, and include a circular segment. The circular cross-section of the grooves 74*a* and 74*b* allows the pivot block 30 to slide along a length of the guide track 26 but prevents the pivot block 30 from becoming detached from the guide track 26 due to forces which are transverse to the axial direction of the guide track 26.

The pivot block 30 also has a pivot pinhole 72 for receiving pivot pins 54, such as the connection members/pivot pins 54 shown in FIGS. 1 and 2, which pivot pins 54 attach to a portion of the doorframe 11 and thereby allow for a pivotal connection between the doorframe 11 and the pivot block 30. The pivot pinhole 72 preferably has a pivot pin sleeve 174. A pivot block cover 155 forms a part of the block 30 at which the pivot pinhole 72 is located.

A pivot block 30 may be initially attached to the guide track 26 by sliding the pivot block 30 into grooves 74*a* and 74*b* over the guide rails 27*a* and 27*b* onto an end of the guide track 26. The structure for engaging the block 30 with the pin 54, and with the guide track 26, are provided in both the driven and the non-driven pivot blocks, since both types of blocks ride up and down slidably along the guide track.

Figure 12:
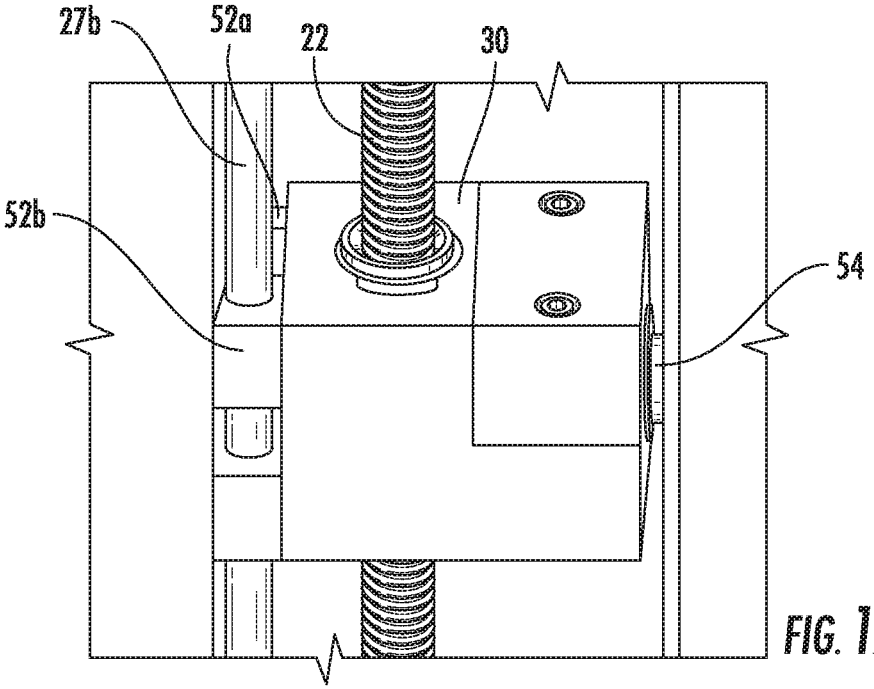
FIG. 12 is an isometric view of the upper, non-driven pivot block of FIGS. 10 and 11 installed on a ball screw driveshaft and a guide rail.

FIG. 12 is an isometric view of the upper, non-driven pivot block of FIGS. 10 and 11 installed on a ball screw driveshaft 22 and a guide rail 26. The pin 54 can be seen entering into the block 30 and extending from the door frame 11.

Figure 13:
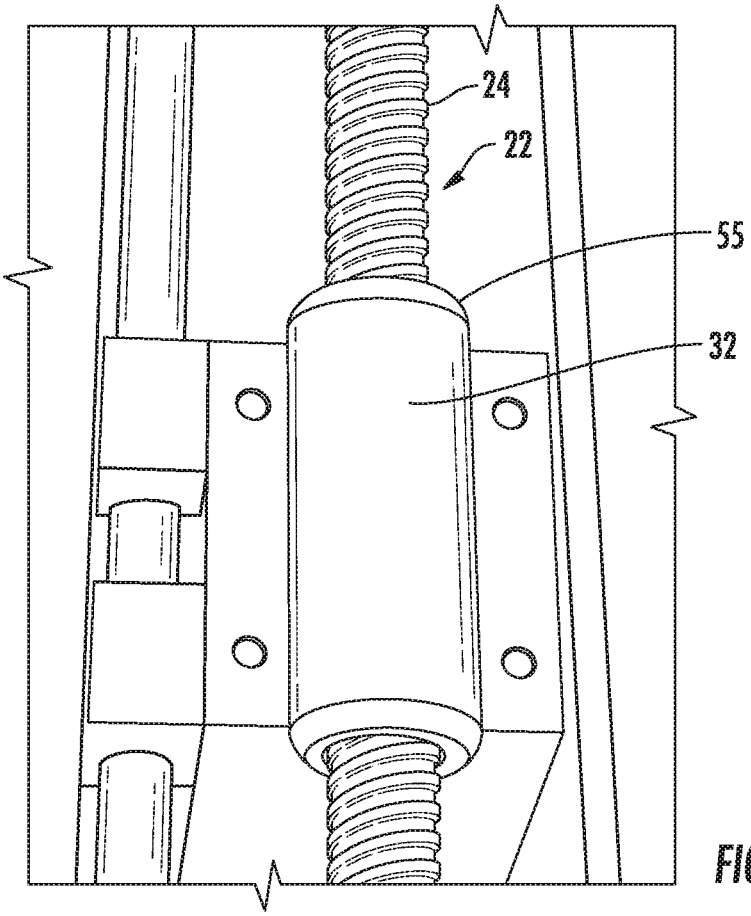
FIG. 13 is an isometric cutaway view of the upper, non-driven pivot block of FIGS. 10-12, showing the ball screw driveshaft passing through a bushing installed in the non-driven pivot block.

FIG. 13 is an isometric cutaway view of the upper, non-driven pivot block of FIGS. 10-12, showing the ball screw driveshaft 22 passing through a guide bearing 32 and a bushing 55 lining the guide bearing 32. The guide bearing 32 with bushing 55 are installed in the non-driven pivot block 30. The bushing may be, for example, an elastomeric material and may have an inner diameter which is greater than a thread diameter of the ball screw 22.

Figure 14:
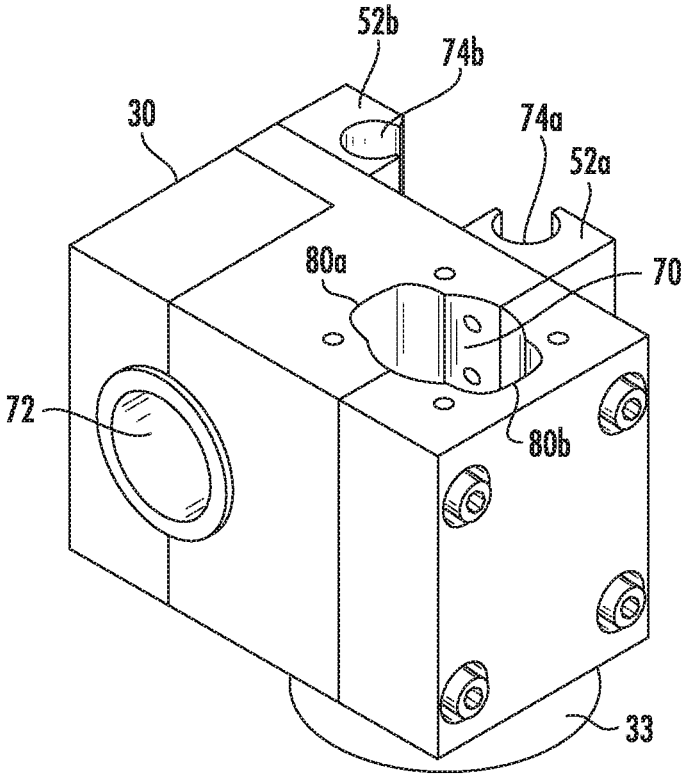
FIG. 14 is an isometric view of a lower, driven pivot block for a ball screw driveshaft.

FIG. 14 is an isometric view of a lower, driven pivot block 30 for coupling with, and being driven by, a ball screw driveshaft 22. As discussed above, the configuration of the driven block differs from that of the non-driven block in that the driven block 30 includes a ball screw drive nut 33 (only the base of which is visible in FIG. 14). As discussed above, the ball screw drive nut 33 has a threaded interior portion which is configured to interlock with the threads 24 of the ball screw 22, thereby resulting in linear motion of the ball screw drive nut 33, and the pivot block 30 of which the screw drive nut 33 forms a part, along the ball screw 22 as the ball screw 22 rotates. In this manner, the rotation of the ball screw 22 about a vertically-oriented axis results in vertical linear motion of the pivot block 30, up or down depending upon the direction of rotation of the ball screw 22.

In particular embodiments, such as shown in FIG. 14, the shape of the ball screw hole 70 may be other than circular, e.g., it may have lobe portions 80*a* and 80*b* into which a structure of the ball screw drive nut 33 may be inserted to prevent rotation of the ball screw drive nut in the same direction as the ball screw 22 as the ball screw 22 rotates. Such rotation, if it were to occur, would reduce or prevent a linear force from being generated between the ball screw 22 and the ball screw drive nut 33 in the driven block 30. As can be seen in the figure, the driven block 30 also has elements 52*a*, 2*b*, 74*b*, 74*a* and the guide track 26.

Figure 15:
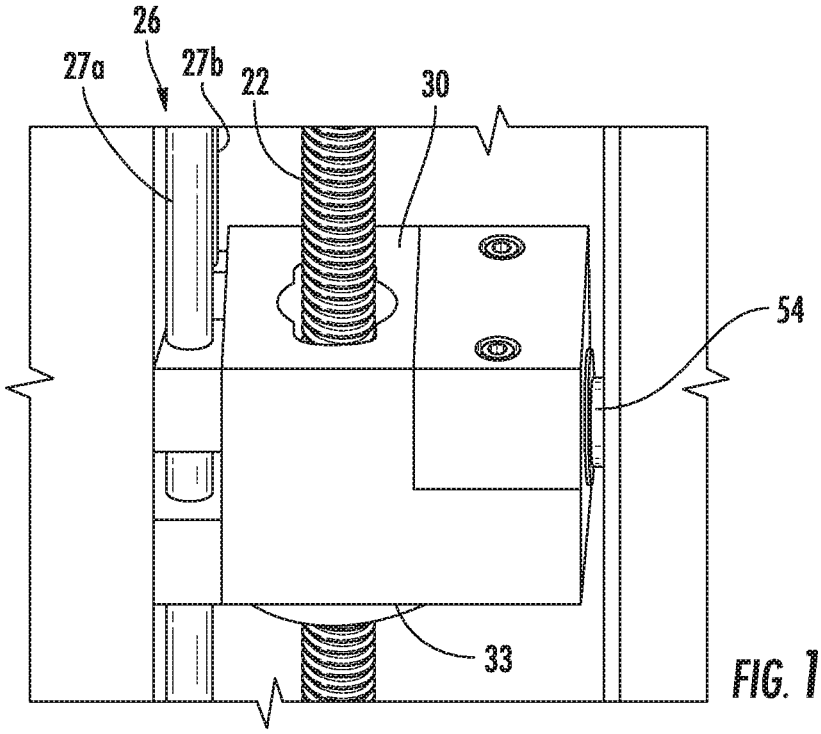
FIG. 15 is an isometric view of the lower, driven pivot block of FIG. 14 installed on a ball screw driveshaft and a guide rail.
Figure 16:
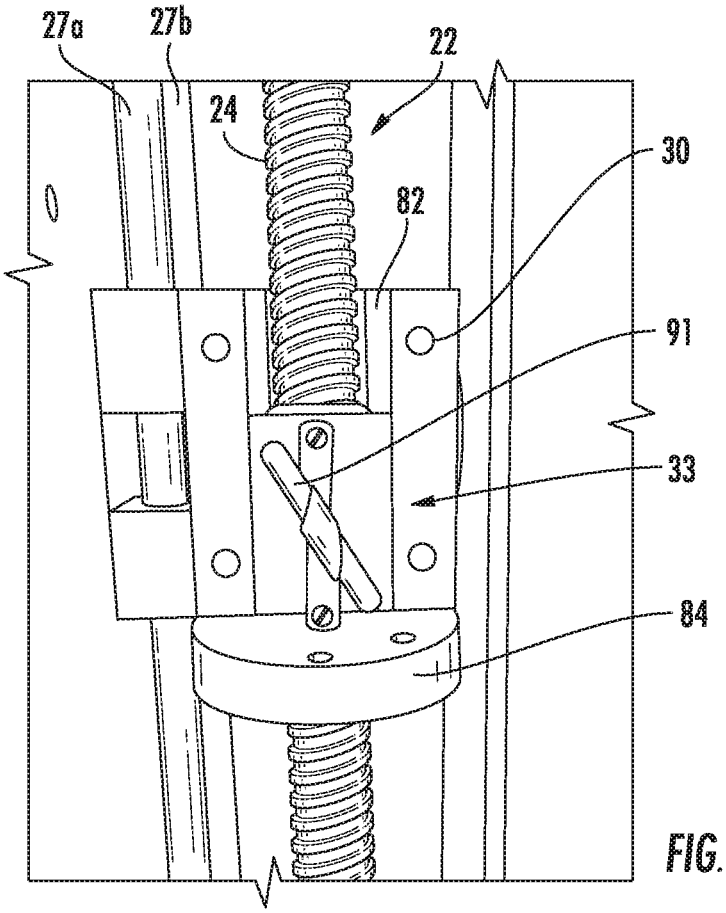
FIG. 16 is an isometric cutaway view of the lower, driven pivot block of FIGS. 14-15, showing the ball screw driveshaft passing through a bushing and a ball screw flange nut installed in the driven pivot block.

FIG. 15 is an isometric view of the lower, driven pivot block of FIG. 14 installed on a ball screw driveshaft 22 and the guide rails 27*a* and 27*b* of the guide track 26. FIG. 16 is an isometric cutaway view of the lower, driven pivot block 30 of FIGS. 14-15, showing the ball screw driveshaft 22 passing through a bushing 82 and a screw drive nut 33, having a ball nut flange 84, installed in the driven pivot block 30. The containment of the nut 33 and flange 84 combination allows the pivot block 30 to move vertically through the transitional motion of ball bearings contained in the nut 33, together forming an external circulation ball screw, as the ball screw 22 is spun. In such a nut, the threading of the nut 33 cooperates with ball bearings in the nut to couple with the threading of the ball screw driveshaft 22. As is known in the art, the ball bearings pass external to the nut, through the return tube 91, and are cycled back into the nut 33, again using the return tube 91, to continue to cooperate with the mating of the threads.

The pivot block 30 is what holds the ball nut 33 from rotating down the ball screw 22. What allows for the movement of the block 30 is the transitional motion of the ball bearings in the ball nut 33 along the ball screw 22 as the screw 22 is turned by the gearbox attached to the motor 62.

Figure 17:
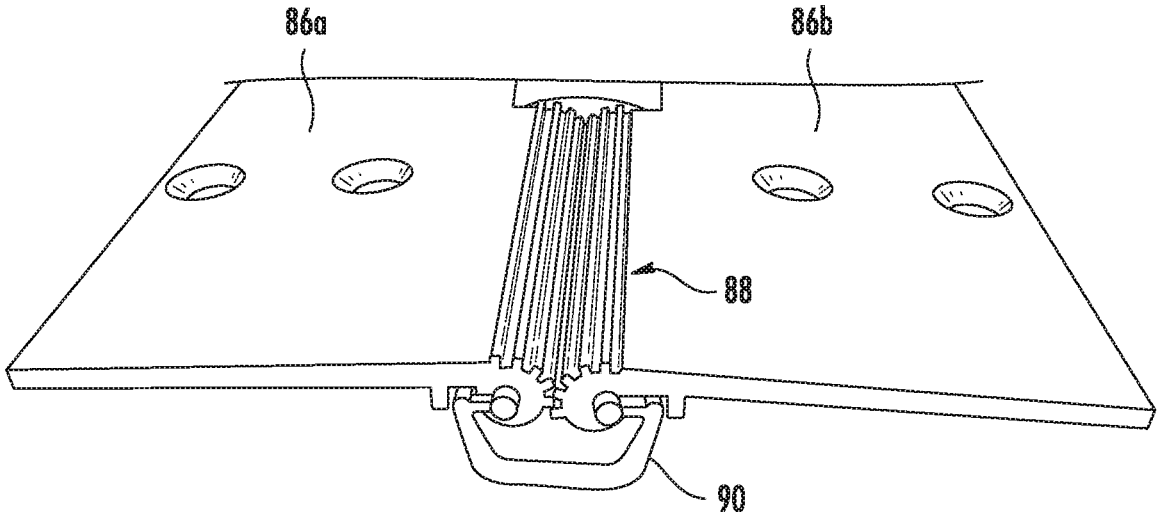
FIG. 17 is an end view of an integrated, continuous door hinge in an open position.
Figure 18:
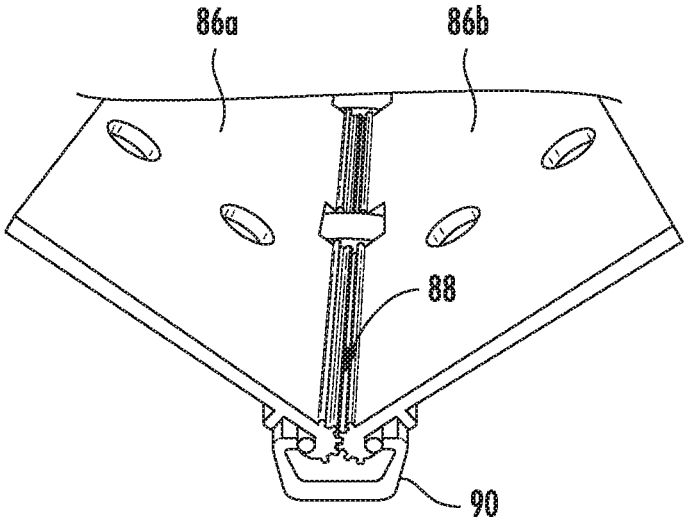
FIG. 18 is an end view of the continuous door hinge of FIG. 17 in a partially-folded position.

FIG. 17 is an end view of an integrated, continuous door hinge in an open position. Such a hinge can be used, for example, for hinges 20*a*, 20*b* and 20*c* discussed above, or hinge 42 discussed above. FIG. 18 is an end view of the continuous door hinge of FIG. 17 in a partially-folded position. The hinge shown in FIGS. 17 and 18 may be configured to run along an entire width of the doorframe 11, thereby providing a hinged connection between frame sections of the doorframe 11 that has desirable aesthetic and insulating characteristics.

In particular, in a disclosed embodiment the arms 86*a* and 86*b* of the hinge have interlocking gear portions 88 at the fulcrum thereof. The geared portions 88 together create a continuous surface which extends along an entire length of the hinge and which does not have gaps, thereby creating a barrier between interior and exterior faces of the hinge. Furthermore, as the hinge closes the geared portions 88 of the hinge arms 86*a* and 86*b* retract into a trough 90, which runs along the entire length of the hinge, thereby providing an additional barrier between the interior and exterior faces of the hinge.

Figure 19:
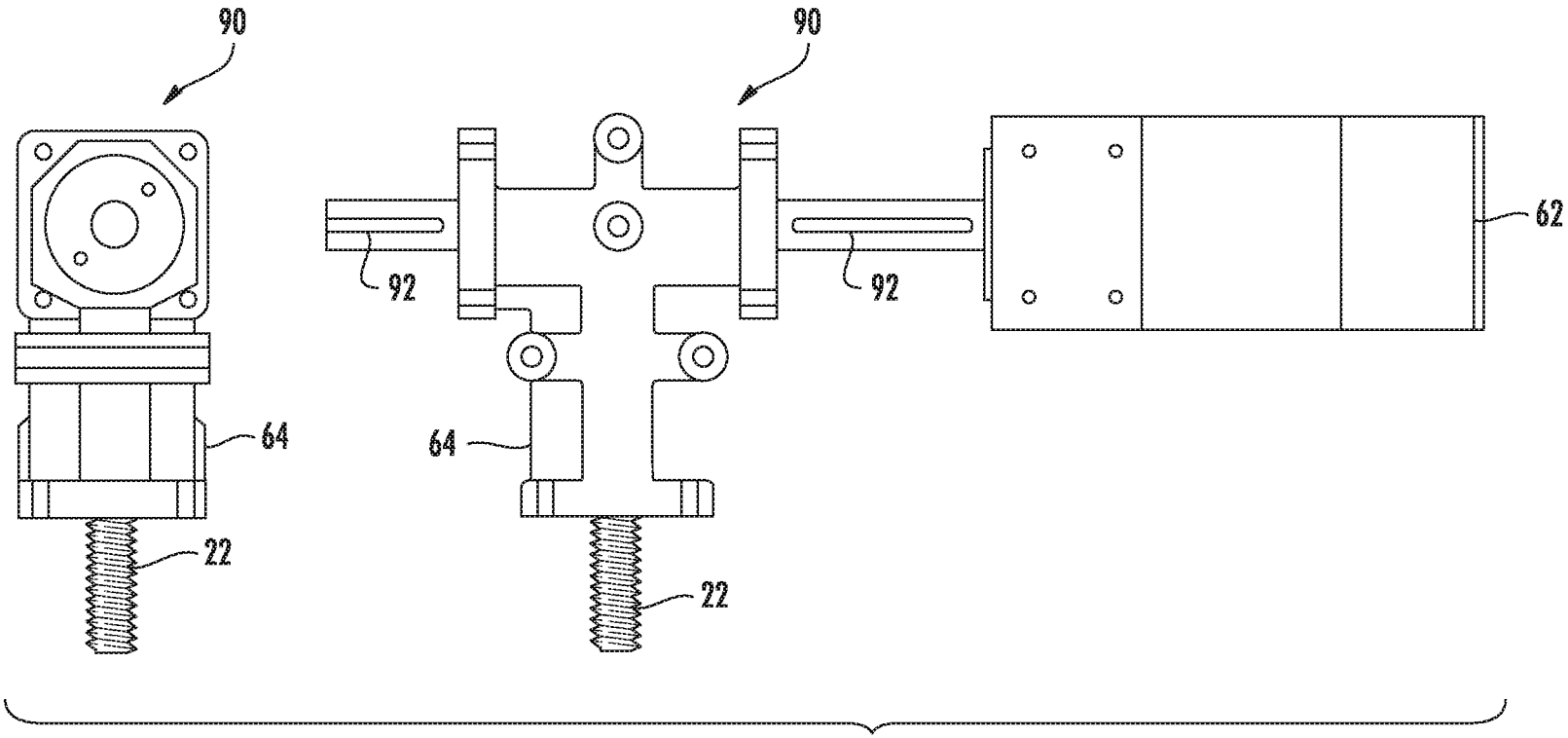
FIG. 19 presents a schematic end view and a schematic side view of a three-way angle gear drive for driving a ball screw driveshaft using a motor with a horizontal orientation.
Figure 20:
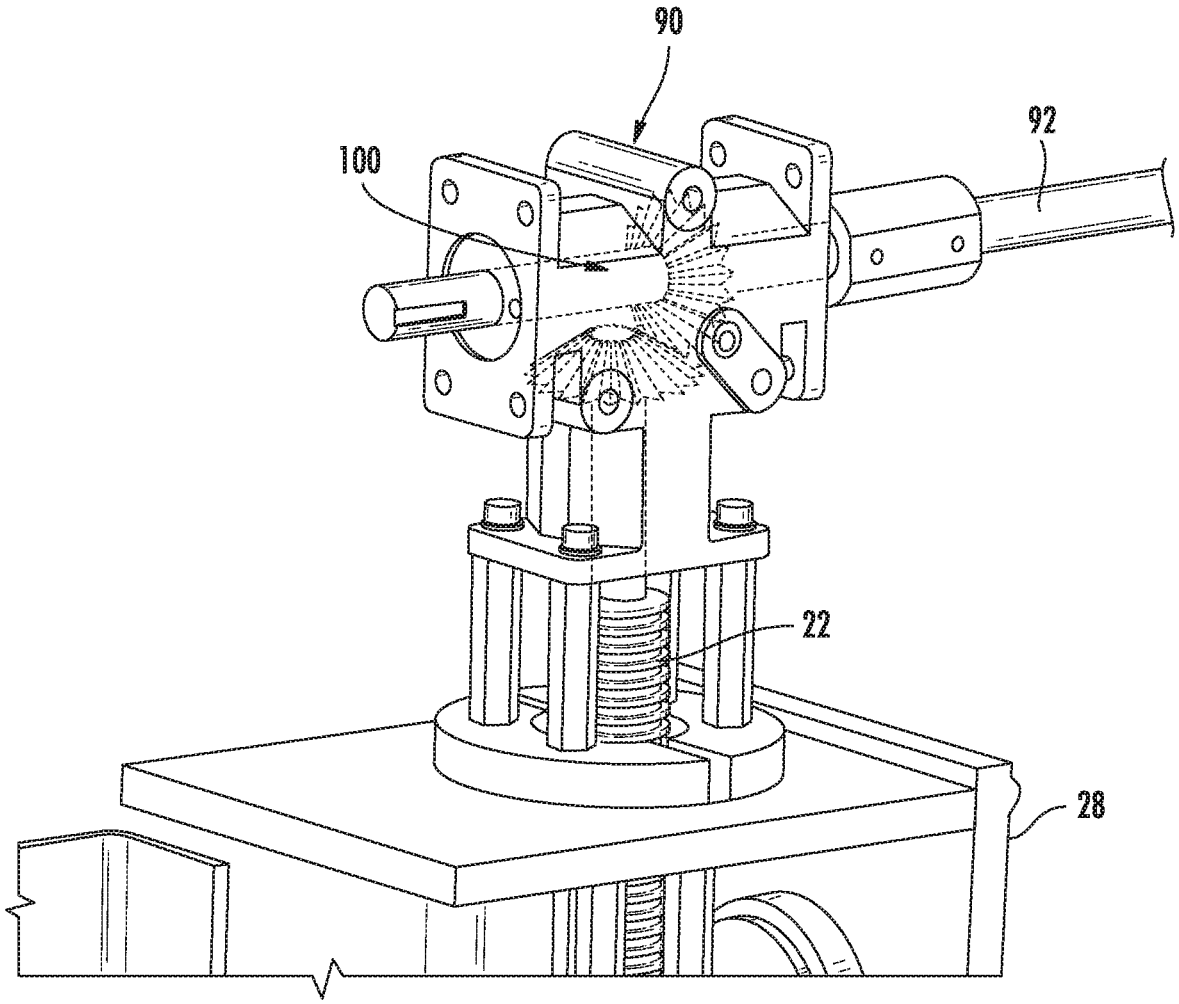
FIG. 20 is an isometric view of the three-way angle gear drive of FIG. 19 installed in a vertical door system to drive a ball screw driveshaft.

FIG. 19 presents a schematic end view and a schematic side view of a three-way angle gear drive for driving a ball screw driveshaft using a motor with a horizontal orientation. FIG. 20 is an isometric view of the three-way angle gear drive of FIG. 19 installed in a vertical door system to drive a ball screw driveshaft. As discussed above, the rotation of the ball screw may be provided by a directly coupled motor having a rotor which is positioned to rotate about a vertically-oriented axis and which is coupled to the ball screw (see, e.g., FIGS. 8-9). However, many conventional drive motors for vertical doors are configured with a rotor which rotates about a horizontal axis, rather than a vertical axis. This is common, for example, with flexible vertical doors which are configured to roll up and roll down, because the roll formed by the door, e.g., at the top of the doorframe, has a horizontal axis of rotation.

Therefore, in particular embodiments a horizontally-oriented motor may be used in conjunction with one or more three-way angle gear drives 90. The gear drive 90 converts the horizontal rotation of the motor 62, which drives a horizontal drive shaft 92, into a vertically-oriented rotation suitable for driving rotation of the ball screw 22. In this way, a conventional motor assembly may be used in conjunction with the novel ball screw drive arrangement described herein. FIG. 20 also provides an x-ray view of the three-way angle gear drive 90 showing the bevel gear assembly 100 for applying vertical rotation from an input horizontal drive shaft.

Figure 21:
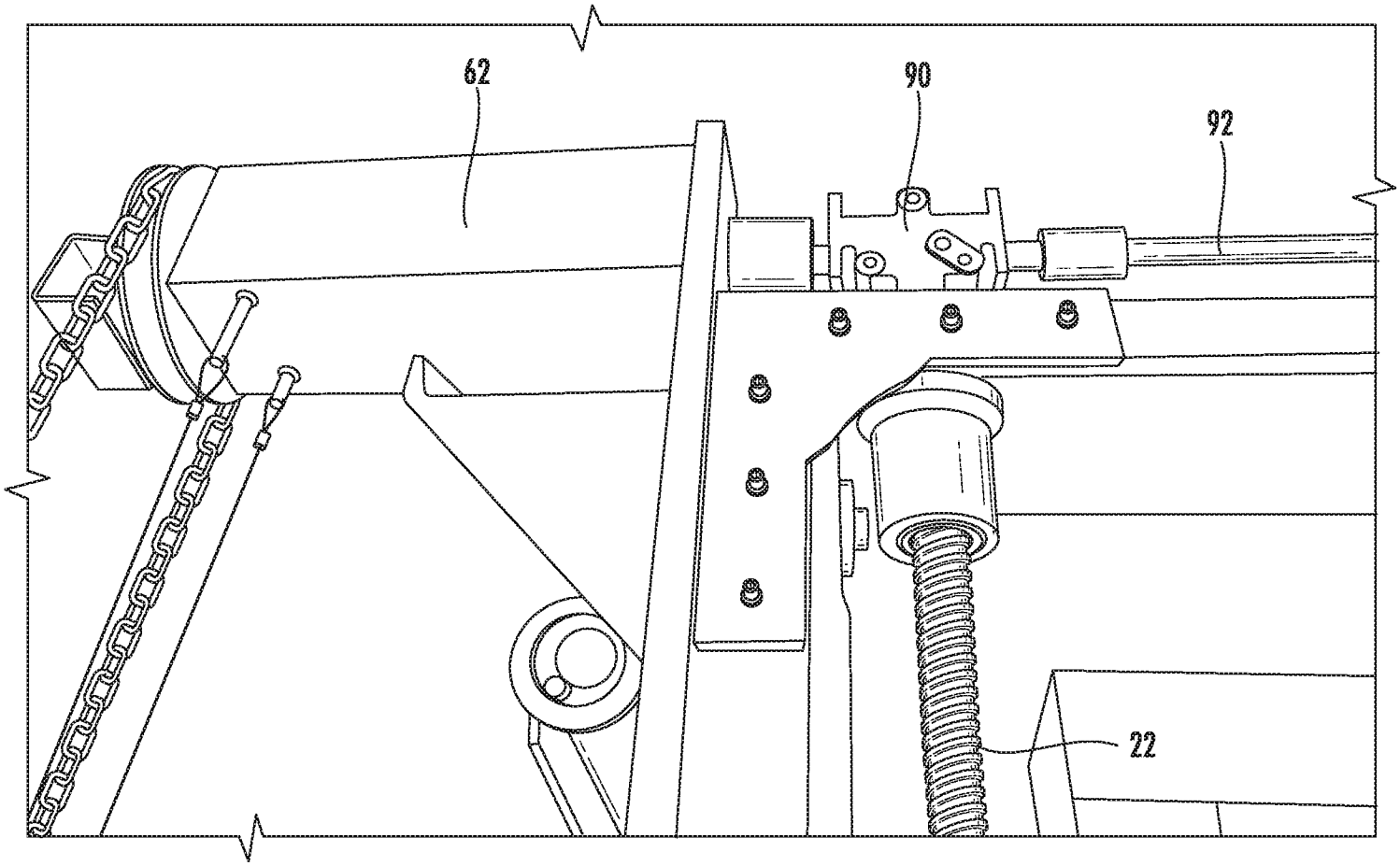
FIGS. 21-25 are views of a partially-assembled, dual-panel folding vertical door system.
Figure 22:
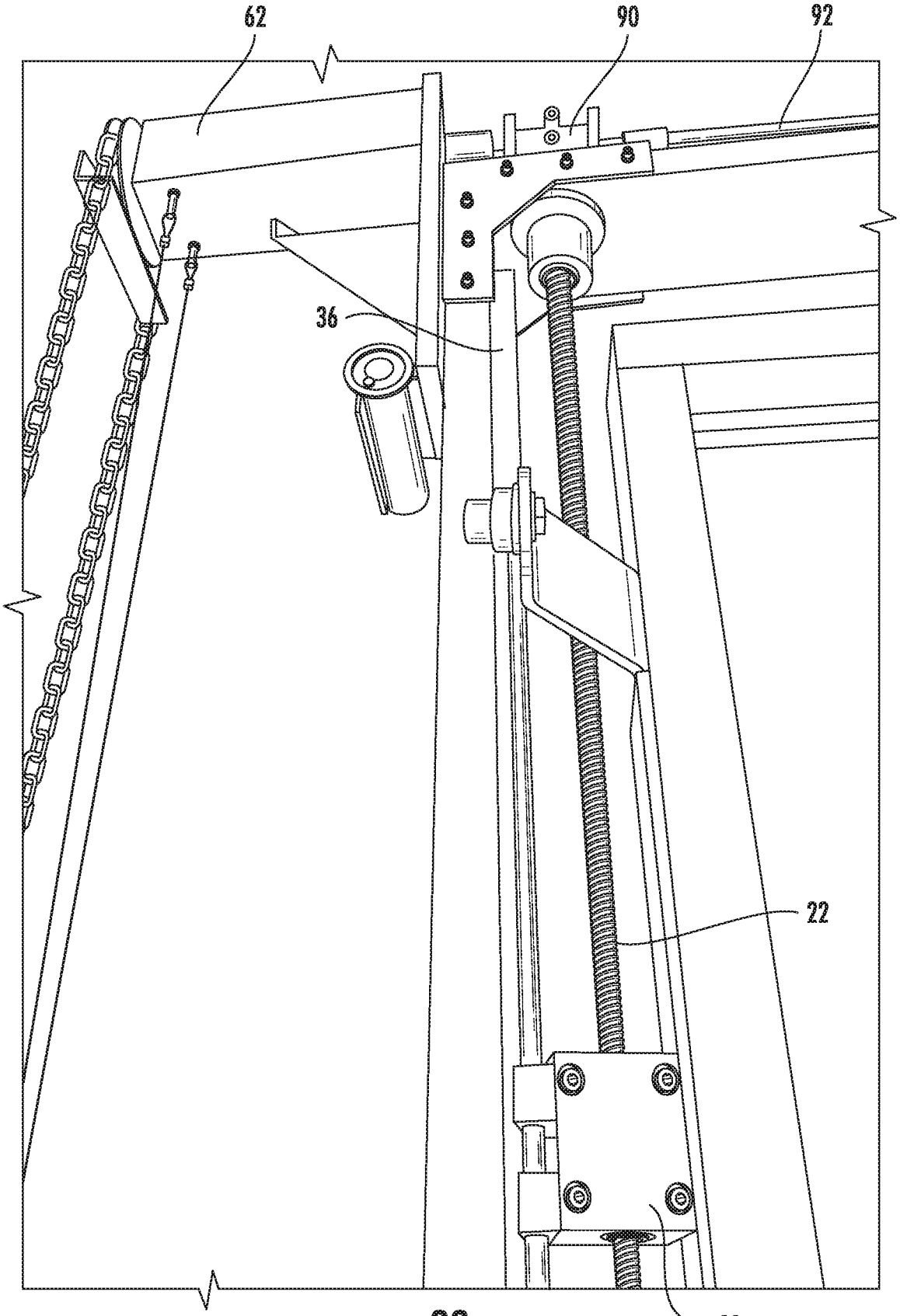

FIGS. 21-25 illustrate a partially-assembled, dual-panel folding vertical door system 1. In the embodiments depicted in FIGS. 21-25, a horizontally-oriented motor assembly, including the horizontal drive shaft 92, is used in conjunction with at least one three-way angle gear drive 90 to rotate the ball screw 22 of the drive mechanism (see, e.g., FIG. 21). The horizontal drive shaft 92 may be, for example, a keyed drive shaft and/or hexagonally shaped drive shaft and/or other geometrically shaped drive shaft. FIGS. 21 and 22 show one side of the folding vertical door system proximate the horizontally-oriented motor 62 and shows the associated angle gear drive 90 for that side of the door system.

Figure 23:
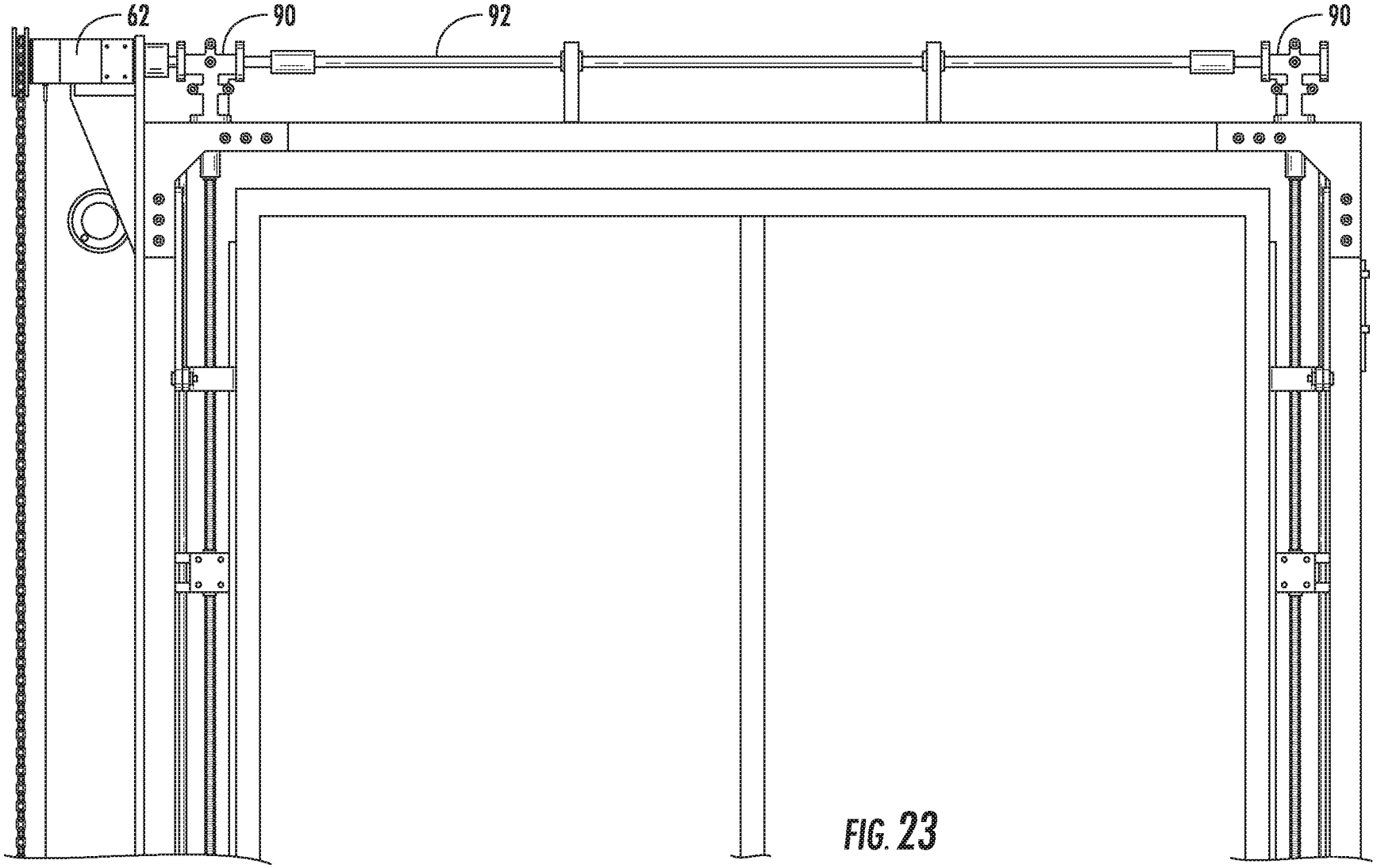
Figure 24:
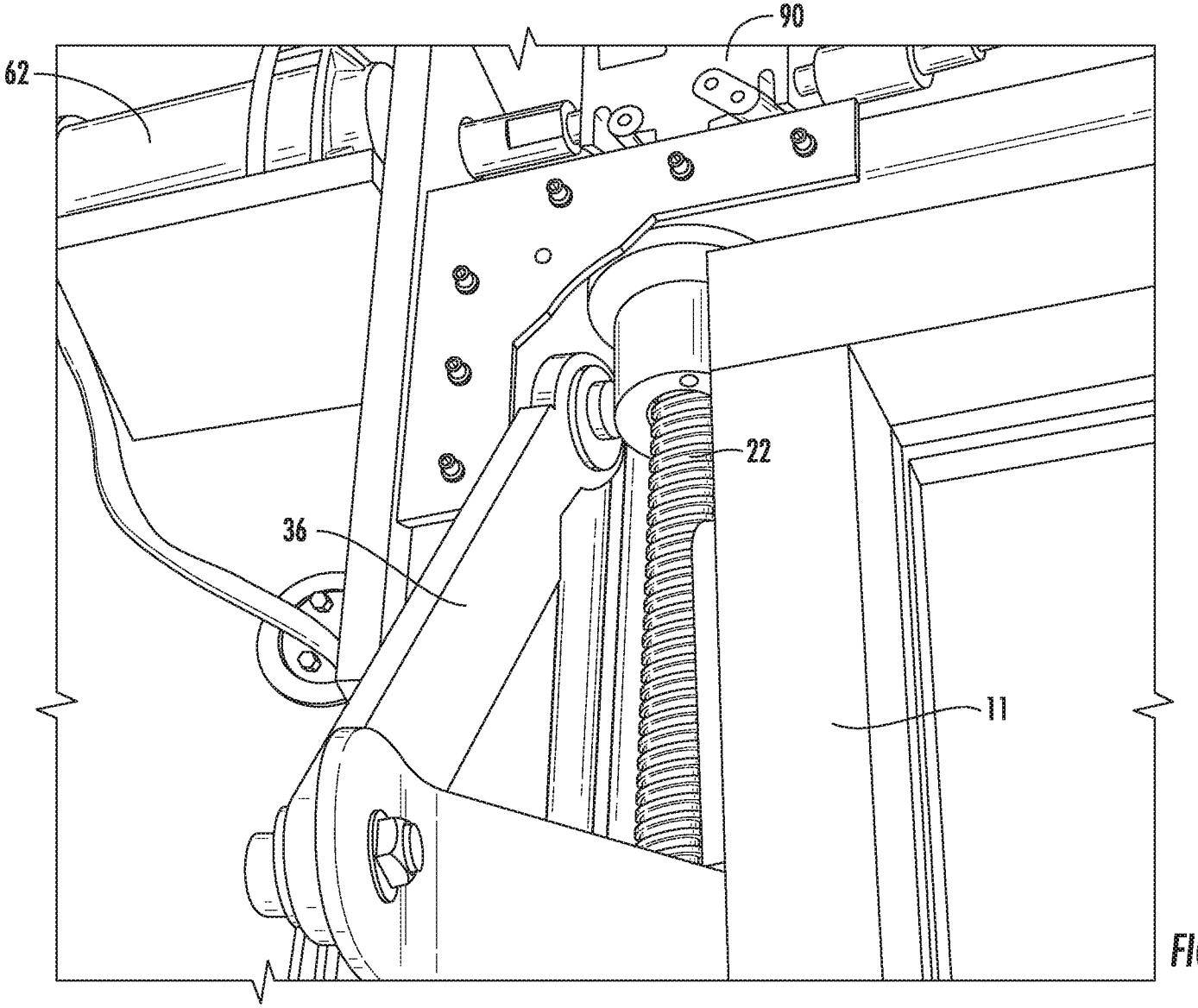
Figure 25:
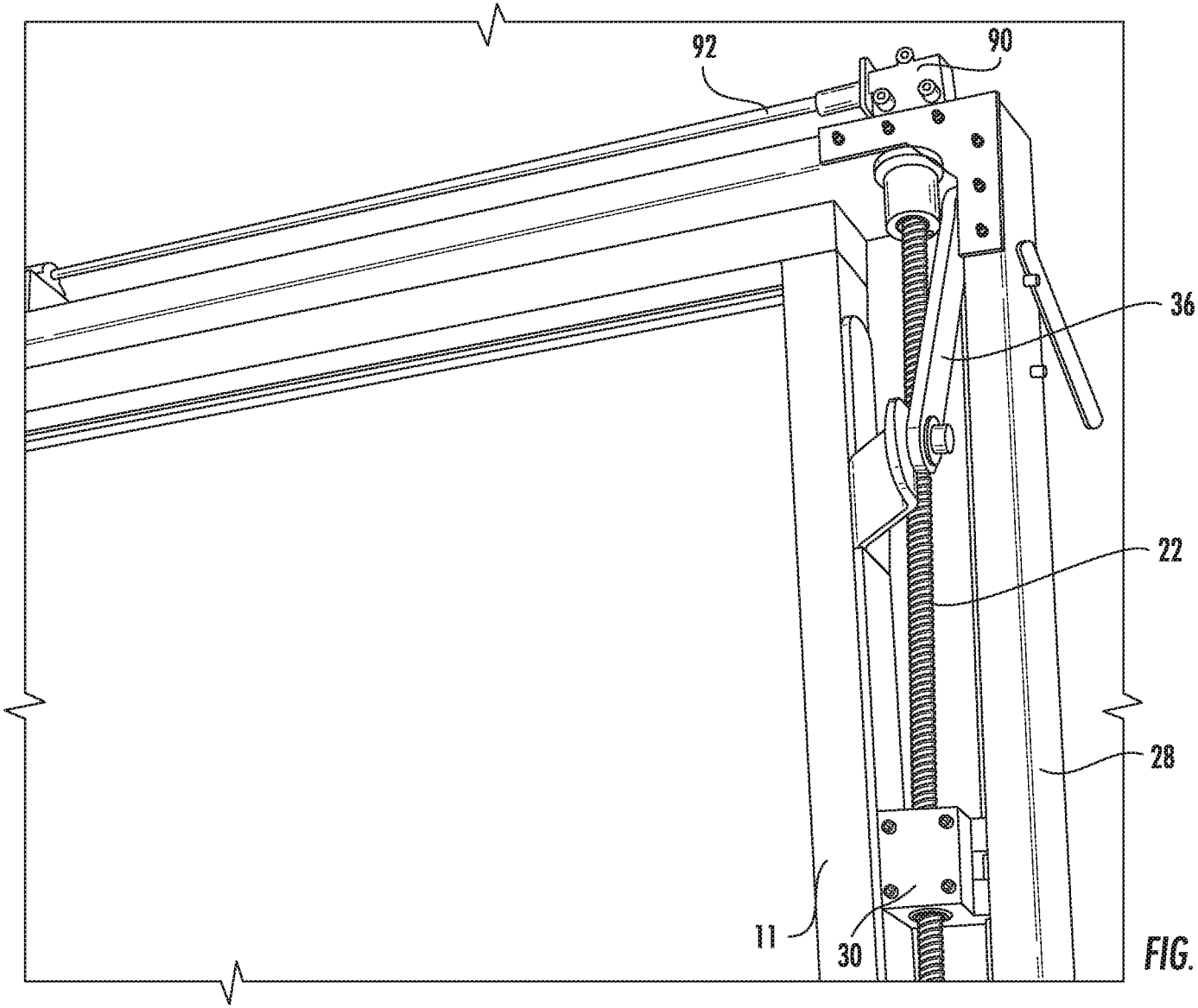

In FIGS. 23-25 show various views of a door system 1 that includes a first and a second ball screw drive shafts 22 positioned on opposite sides of the vertical door, and having the motor 62 attached at a first side, and oriented horizontally so as to, drive a horizontal drive shaft 92. FIG. 23 showing a full frontal view, FIG. 24 being a detailed view of the upper left of FIG. 23 and FIG. 25 being a detailed view of the upper right of FIG. 23. In such a configuration, the drive shaft 92 driven by a single motor 62 is coupled to first and a second three-way angle gears 90. Each angle gear 90 has a horizontal input shaft and a vertical output shaft coupled to the ball screw drive shaft of the respective side of the door system 1.

The input shaft of the first angle gear 90, i.e., the one closer to the motor 62, in interconnected with the drive shaft 92 of the motor. The first angle gear 90 has a horizontally oriented output shaft that rotates synchronously with the drive shaft by gearing arranged in the first angle gear 90. Also, as discussed above, the first angle gear 90 also has a vertical output shaft coupled to drive a vertically oriented ball screw 22 for one side of the door system emerging from the bottom of the first angle gear 90.

The output shaft of the first angle gear 90, is connected to rotate synchronously with the input shaft and the first output shaft. As can be seen in FIGS. 24 and 25, the upper point of the door is connected to the drive system 13 through a lever arm 36, which is connected to the top of the system support frame 28.

In particular embodiments, the system may include first and second ball screw drive shafts positioned on opposite sides of the vertical door; and a first and a second three-way angle gear, each having an input shaft and a first output shaft interconnected to rotate synchronously and a second, vertical output shaft connected to rotate synchronously with the input shaft and the first output shaft (see, e.g., FIG. 25).

In such embodiments, the motor is oriented so that a rotor thereof rotates about a horizontal axis, the motor being operatively connected to the input shaft of the first three-way angle gear to rotate a first ball screw driveshaft which is attached to the second output shaft of the first three-way angle gear. The first output shaft of the first three-way angle gear is connected to the input shaft of the second three-way angle gear by a horizontal drive shaft which runs across the top of the door frame to rotate the second ball screw driveshaft which is attached to the second output shaft of the second three-way angle gear.

In FIGS. 22, 23, and 25, a pivot block 30 is shown that is configured to slide along the ball screw 22 without engaging threads of the ball screw 22, i.e., to act as a non-driven block, and which is pivotally attached to the doorframe 11. FIG. 24, in particular, shows that the top frame section of the doorframe is attached to the support frame by a lever 36.

Figure 26:
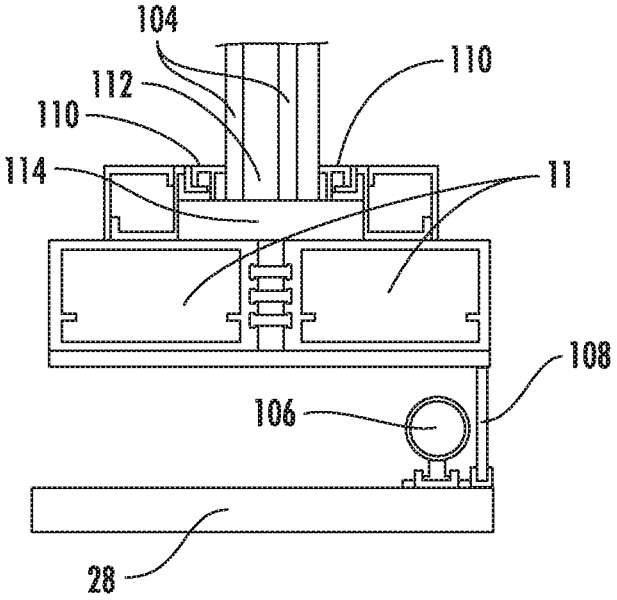
FIG. 26 is a partial top schematic view of a vertical door system having externally fastened weather seals.
Figure 27:
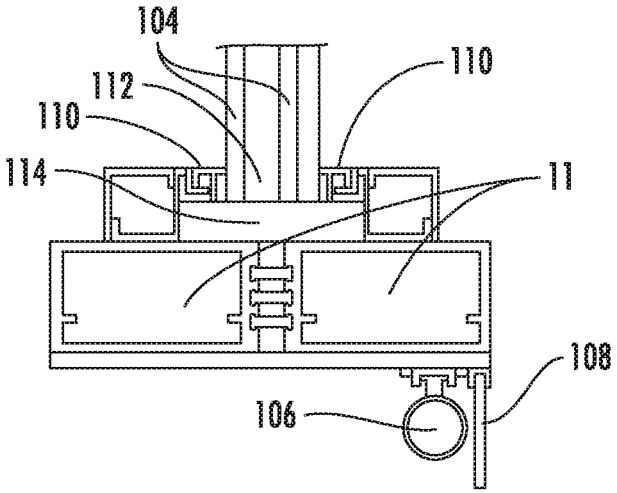
FIG. 27 is a partial top schematic view of a vertical door system having a frame-mounted weather seals.

FIGS. 26 and 27 are partial top schematic views of embodiments of the vertical door system utilizing weather seals. Weather seals, such as, for example, brushes and bulb gaskets, are used because, as a practical matter, the doorframe must be somewhat smaller than the opening in the support frame to prevent the doorframe from contacting the support frame as the door is opened and closed.

FIG. 26 is a partial top schematic view of a vertical door system 1 having externally-fastened weather seals. In this case weather seals include a bulb gasket weather seal 106 and a brush weather seal 108. Other features illustrated in FIG. 26 include glass or optional filler 104, rubber stops 110, which hold glass or filler in the door in place, a spacer 112 for the glass or filler, a block 114 to keep the glass or filler in place within the frame 11, and a hardware jamb cover 28. Note that the frame 11 is configured to be a thermally broken frame with an exterior to secure glass or optional filler. If glass is used, the glass is held in the center of the framed sections with a retainer attached to the frame and rubber stops, i.e., insulating members attached to the retainer to hold the glass in place.

FIG. 27 is a partial top schematic view of a vertical door system 1 having frame-mounted weather seals. The only difference between FIGS. 27 and 26 is that in FIG. 27 the seals 106, 108 are fastened to the frame 11, instead of to the hardware/jam cover 28, as in FIG. 26.

Figure 28:
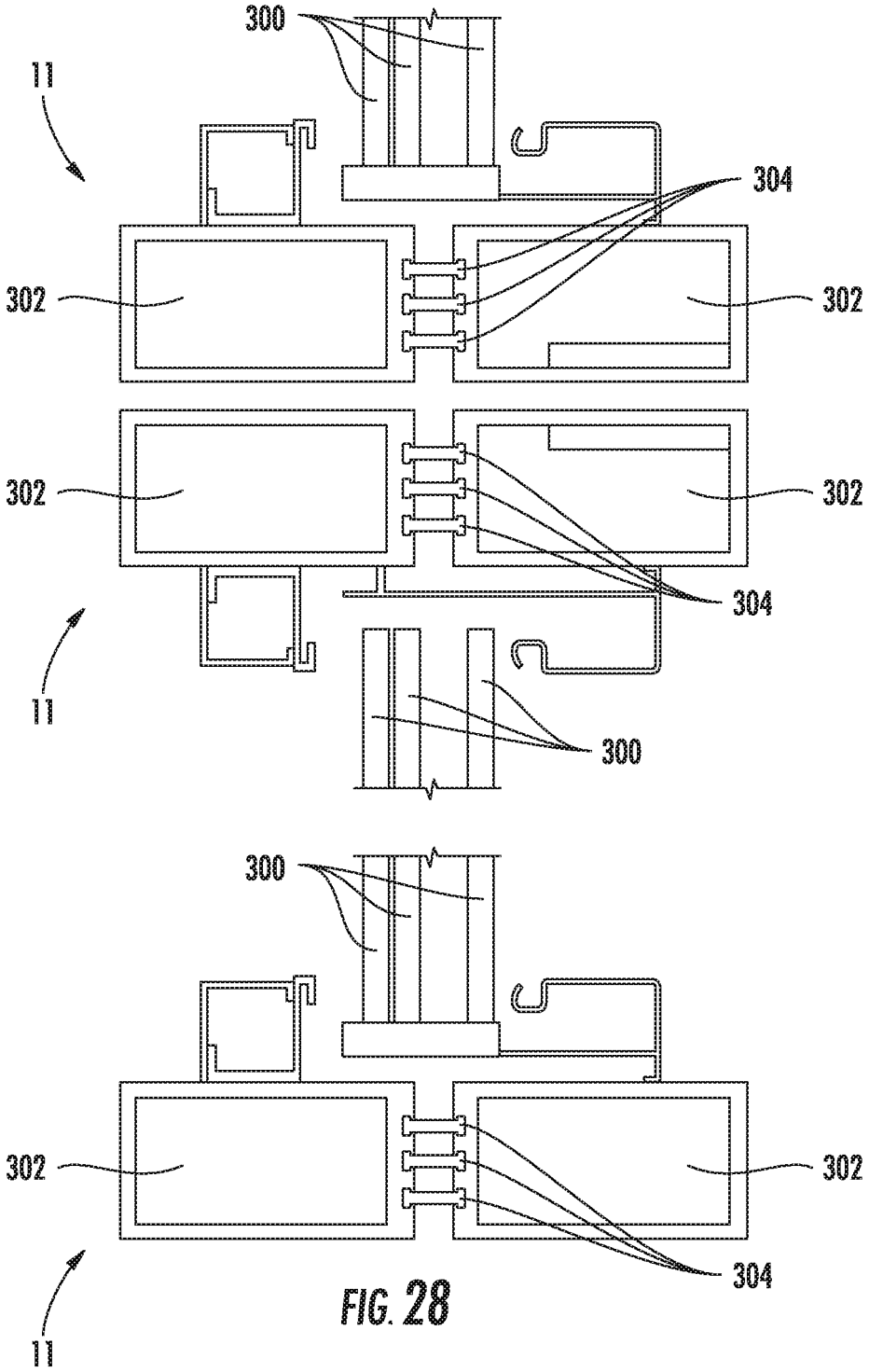
FIGS. 28-29 are a partial top schematic views of a vertical door showing insulated glass panels installed in a frame with internal insulation blocks and front-back thermal breaks.
Figure 29:
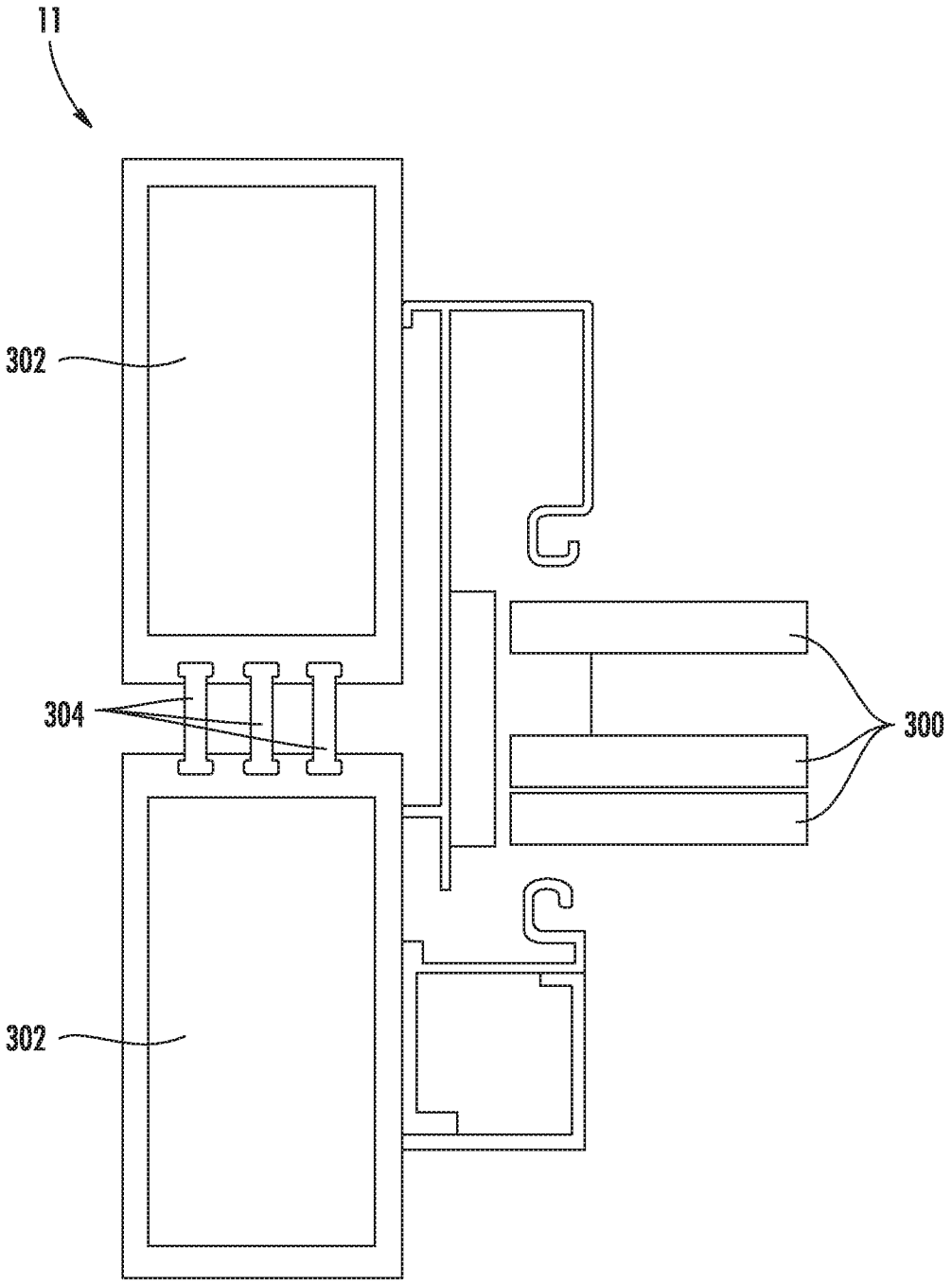

FIGS. 28-29 are a partial top schematic views of a vertical door showing insulated glass panels 10 installed in a frame with internal insulation blocks 302 and front-back thermal breaks 304. The thermal break 304 may be formed by providing separate support elements for the interior and exterior surfaces of the doorframe, such as, for example structural steel tubes. The steel tubes of the interior and exterior surfaces may be joined by, e.g., a plurality of spaced-apart members, which reduce thermal transmission between the interior and exterior frame tubes. In addition, as noted above, insulating members may be installed between the glass panes and the structural members of the doorframe to reduce thermal transmission between the glass and the doorframe. Insulated glass panels 300 are also utilized, as shown in the figures.

Figure 30:
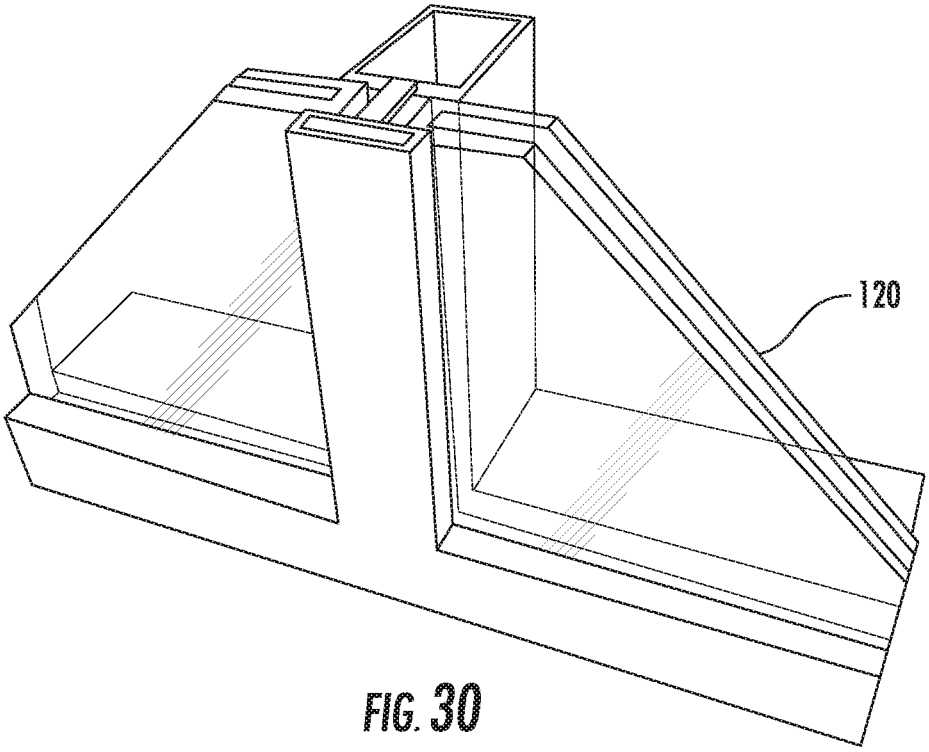
FIGS. 30-31 are partial views of a vertical door frame with insulated glass configurations installed therein.
Figure 31:
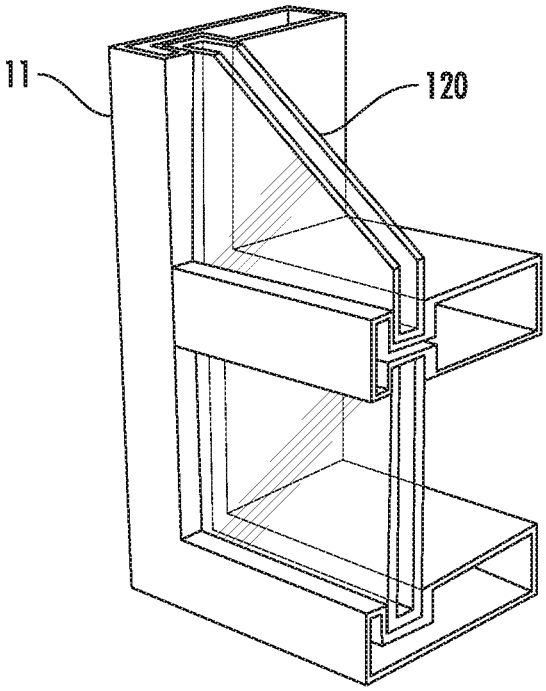

FIGS. 30-31 are partial views of a vertical door frame with insulated glass configurations 120 installed therein.

Figure 32:
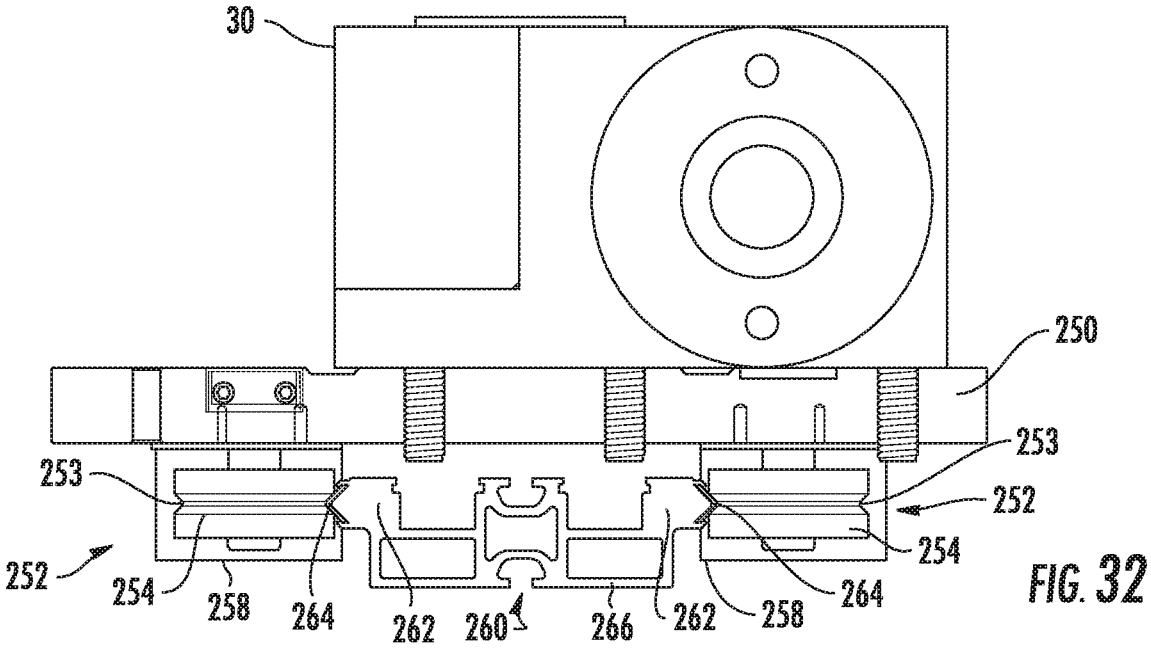
FIGS. 32 and 33 show an alternative embodiment of the attachment of the blocks to the guide track.
Figure 33:
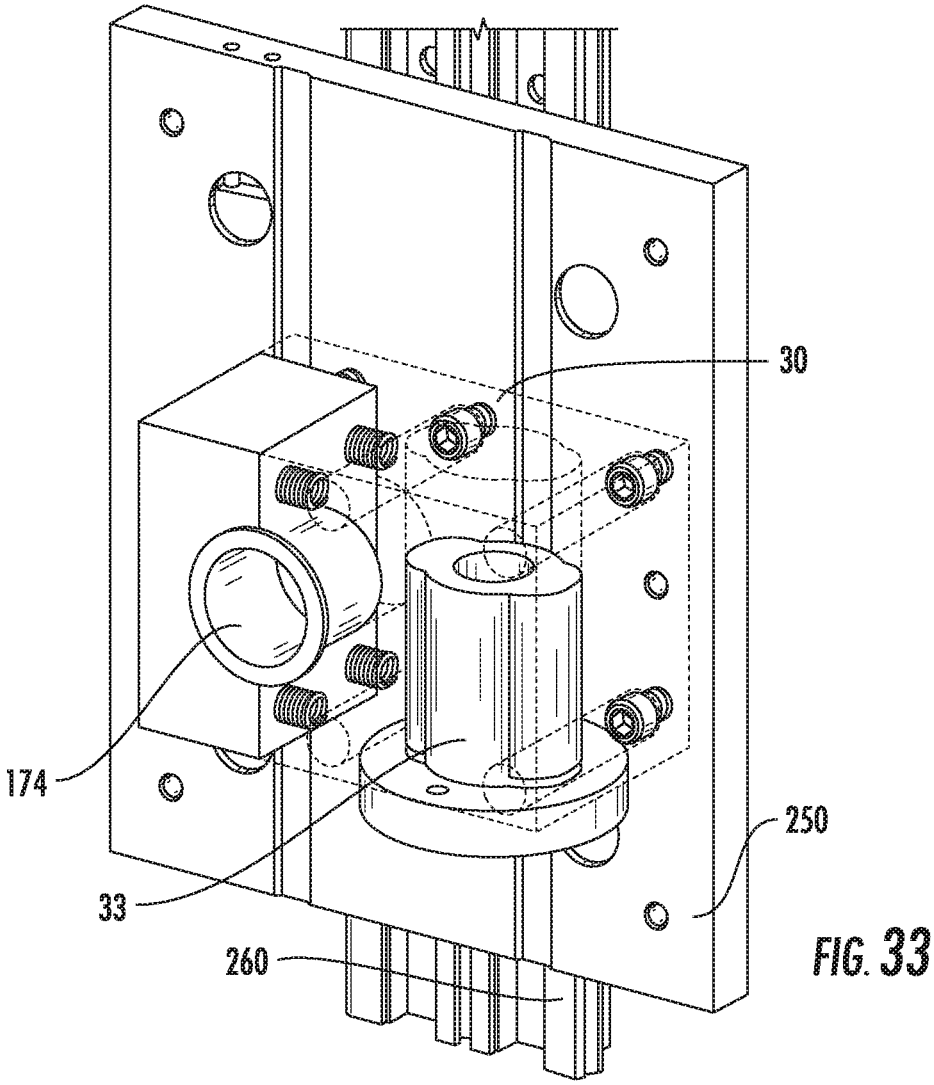

FIGS. 32 and 33 show an alternative embodiment in which the pivot block 30 has track attachment portions 252 which extend from a carriage 250 between the block 30 and the guide track 260 of the support tower 28 and which have vertically-oriented grooved wheels 254 configured to attach to the guide track 260. The grooved wheels 254 each have a circumferential groove 253.

In this particular embodiment, the guide track 260 of the tower 28 has vertical members, i.e., guide rails 262, which have a cross-section which includes a section of a pointed angle edge 264 and a portion that joins a flat portion, i.e., the base portion 266, of the guide track 260. The base portion 266 of the guide track attaches to the support tower 28, e.g., with fasteners or by welding.

The grooved wheels 254 of the guide track attachment portions 252 of the pivot block have a corresponding cross-section which includes a pointed angle groove segment (i.e., groove) 253 which allows the pivot block 30 to roll along a length of the guide track 260 but prevents the pivot block from becoming detached from the guide track 260 due to forces which are transverse to the axial direction of the guide track 260 and which further reduces friction on track rail when forces are applied in lateral direction.

The grooved wheels may also be covered by a wheel cover 258 for safety and longevity. The track attachment portion 252 may also have a polymeric lubricator with a corresponding cross-section which includes a pointed angle groove segment which lubricates the pointed angle guide track as the pivot block travels along a length of the guide track. A pivot block 30 may be attached to the guide track 260 by rolling it onto an end thereof. Just as in the first embodiment, the pivot block 30 in this embodiment also has the pivot pinhole 72, with associated sleeve 174, for receiving a pin 54 attached to a portion of the doorframe 10 to thereby allow for a pivotal connection between the doorframe 10 and the pivot block 30.

Alternatively to the use of a ball screw drive, the above-described embodiments can be achieved using a worm screw, and/or a lead screw, and/or a hexagonal or other geometrically shaped shaft, and/or a chain mechanism for raising and lowering the door.

Although example embodiments have been shown and described in this specification and figures, it would be appreciated by those skilled in the art that changes may be made to the illustrated and/or described example embodiments without departing from their principles and spirit.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A vertical door system, comprising:

a door, arranged in a door opening and having a door frame, the door frame having at least one frame section;

an operator;

two vertical supports configured to: (a) be installable on opposite sides of the door opening and (b) support the vertical door, at least one of the vertical supports having:

a guide track on a surface of the vertical support facing toward the door opening; and a drive system comprising:

an elongated threaded rod drivable by the operator via a gearing arranged between the operator and the threaded rod, the threaded rod being configured for operative connection with the operator for rotating the threaded rod about the longitudinal axis of the threaded rod in a first and a second direction, the longitudinal axis being vertically-oriented and parallel to the guide tracks; and one or more blocks, each of the one or more blocks comprising a guide track connecting portion configured to connect to one of the guide tracks so the connected block is freely moveable along a respective one of the guide tracks, each block having a through-bore for accepting the threaded rod so that the block is positioned on the threaded rod and is moveable along the threaded rod, wherein each of the one or more blocks comprises a door frame connecting portion arranged on a side of the block opposite the guide track connecting portion, each block being configured to pivotally connect to the vertical door by the door frame connecting portion, wherein at least one of the one or more blocks comprises a drive nut configured to mate with threads of the threaded rod without rotating relative to the block or relative to the threaded rod, so that the block having the drive nut acts as a driven block which moves in an upward direction when the threaded rod rotates in the first direction and in a downward direction when the threaded rod rotates in the second direction;

wherein the guide track connecting portion configured to connect to one of the guide tracks comprises slider blocks configured to be slidable along the guide tracks;

wherein the guide track connecting portion has two guide track attachment portions extending from the block and having vertically-oriented grooves configured to slidably couple with the guide track; and wherein the guide track has two vertical guide rails and a common base portion attached to the support, wherein each of the vertical guide rails has a cross-section that includes a section of a circle and a portion that joins the common base portion, of the guide track, wherein the vertically-oriented grooves of the guide track attachment portions have a cross-section corresponding to the cross-section of the respective vertical guide rails so that the block is slidable along a length of the guide track but is prevented from becoming detached from the guide track due to forces transverse to an axial direction of the guide track.

2. The door system according to claim 1, wherein the door frame comprises only a single frame section, wherein movement of one or more driven blocks raises or lowers the single frame section, thereby opening or closing the vertical door.

3. The door system according to claim 1, wherein the door frame comprises a plurality of frame sections interconnected to one another by hinges.

4. The door system according to claim 3, wherein each of the plurality of frame sections has a pair of connection members extending from opposite sides of the respective frame section, each connection member being configured to engage with the door frame connecting portion of one of the one or more blocks to form a pivotal connection thereto, wherein movement of one or more driven blocks raises or lowers a bottom-most frame section, to which the one or more driven blocks are connected, thereby opening or closing the vertical door.

5. The door system according to claim 1, further comprising:

a three-way angle gear having an input shaft and a first output shaft interconnected to rotate synchronously with the input shaft, and a second, vertical output shaft connected to rotate synchronously with the input shaft and the first output shaft, wherein the operator comprises a motor which is oriented so that a rotor thereof rotates about a horizontal axis, the motor being operatively connected to the input shaft of the three-way angle gear to rotate the at least one threaded rod attached to the second output shaft of the three-way angle gear.

6. The door system according to claim 1, wherein the operator comprises a motor which is oriented so that a rotor thereof rotates about a horizontal axis and both of the pair of vertical supports include the drive system and the guide track on a surface of the respective vertical support facing toward the door opening such that:

first and a second vertical threaded rods are positioned, respectively, on opposite sides of the vertical door, the system further comprising:

first and a second three-way angle gears, each having an input shaft and a first output shaft interconnected to rotate synchronously and a second, vertical output shaft connected to rotate synchronously with the input shaft and the first output shaft, wherein the motor is operatively connected to the input shaft of the first three-way angle gear to rotate the first vertical threaded rod attached to the second output shaft of the first three-way angle gear, and the first output shaft of the first three-way angle gear is connected to the input shaft of the second three-way angle gear by a horizontal drive shaft to rotate the second vertical threaded rod attached to the second output shaft of the second three-way angle gear.

7. The door system according to claim 1, wherein the through-bore is configured as a guide bearing.

8. The door system according to claim 1, wherein the common base portion is attached to the support with fasteners or by welding.

9. The door system according to claim 4, wherein the door frame connecting portion has a pivot pin hole configured to accommodate a connection member extending from one of the one or more frame sections.

10. The door system according to claim 1, wherein an upper part of a highest frame section is coupled to the support by an arm.

11. The door system according to claim 1, wherein the door frame comprises a thermally-broken frame having interior and exterior frame portions, and separator materials arranged therebetween to prevent temperature transfer through the door frame and to prevent resulting condensation on the interior frame portion, the door system further comprising:

brush seals configured to block infiltration of unwanted pests; and a bulb seal configured to provide a seal at the perimeter of the door to block air and light.

12. The door system according to claim 1, wherein the guide track connecting portion of the block comprises vertically-oriented grooved wheels which extend from a carriage arranged between the block and the guide track of the support tower, the vertically-oriented grooved wheels being configured to attach to the guide track, each grooved wheel having a circumferential groove configured to engage a section of guide rails of the guide track having a pointed angle edge.

13. The door system according to claim 1, further comprising:

a three-way angle gear having an input shaft and one or more output shafts interconnected to rotate synchronously with the input shaft, wherein the operator comprises a motor which is oriented so that a rotor thereof rotates about a horizontal axis, the motor being coupled to a horizontal drive shaft, which is coupled to the input shaft of the three-way angle gear to rotate the at least one or more output shafts.

* * * * *